US011207884B2

(12) United States Patent
Suematsu et al.

(10) Patent No.: US 11,207,884 B2
(45) Date of Patent: Dec. 28, 2021

(54) PRINTING APPARATUS AND HEAD TEMPERATURE CORRECTION METHOD

(71) Applicant: CANON KABUSHIKI KAISHA, Tokyo (JP)

(72) Inventors: Yushi Suematsu, Yokohama (JP); Daisuke Kobayashi, Kawasaki (JP); Kenichi Oonuki, Nishitokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 16/834,152

(22) Filed: Mar. 30, 2020

(65) Prior Publication Data

US 2020/0316933 A1 Oct. 8, 2020

(30) Foreign Application Priority Data

Apr. 5, 2019 (JP) ..... JP2019-073079

(51) Int. Cl.
*B41J 2/045* (2006.01)

(52) U.S. Cl.
CPC ..... *B41J 2/0454* (2013.01); *B41J 2/0458* (2013.01); *B41J 2/04553* (2013.01); *B41J 2/04563* (2013.01)

(58) Field of Classification Search
CPC ... B41J 2/0454; B41J 2/04553; B41J 2/04563
See application file for complete search history.

(56) References Cited

U.S. PATENT DOCUMENTS

| | | | | |
|---|---|---|---|---|
| 8,783,832 | B2 | 7/2014 | Oonuki et al. | |
| 8,888,223 | B2 | 11/2014 | Oonuki et al. | |
| 9,862,187 | B1 * | 1/2018 | Mu | B41J 2/04588 |
| 2004/0239711 | A1 * | 12/2004 | Koehler | B41J 2/17546 347/19 |
| 2011/0221820 | A1 * | 9/2011 | Shibata | B41J 2/0458 347/17 |
| 2019/0176467 | A1 * | 6/2019 | Azuma | B41J 2/04508 |

FOREIGN PATENT DOCUMENTS

JP 2013-006337 A 1/2013

* cited by examiner

*Primary Examiner* — Julian D Huffman
(74) *Attorney, Agent, or Firm* — Venable LLP

(57) ABSTRACT

A printing apparatus includes a printhead with a plurality of print elements for generating energy used for printing an image on a print medium, a first temperature detection element and a second temperature detection element at positions different in a direction of a print element array in which the plurality of print elements are arrayed. The apparatus corrects a signal concerning a head temperature based on an output from the first temperature detection element, and corrects, based on the corrected signal concerning the head temperature, a signal concerning a head temperature output from the second temperature detection element.

20 Claims, 16 Drawing Sheets

PRINTING APPARATUS AND HEAD TEMPERATURE CORRECTION METHOD

BACKGROUND OF THE INVENTION

Field of the Invention

The present invention relates to a printing apparatus and a head temperature correction method, and particularly to, for example, a printing apparatus for executing printing by discharging ink from a printhead according to an inkjet method, and a head temperature correction method for the printhead.

Description of the Related Art

Conventionally, among inkjet printing apparatuses, there is known a thermal inkjet printing apparatus (to be referred to as a printing apparatus hereinafter) for discharging ink using a bubble generated by a heating element such as a heater. In this printing apparatus, growth of a generated bubble is largely influenced by an ink temperature in the vicinity. Comparing a case where an ink temperature is high in the vicinity of the bubble with a case where an ink temperature is low in the vicinity of the bubble, a bubble grows larger as the ink temperature in the vicinity of the bubble is higher. The size of a bubble is reflected on an ink volume (to be referred to as a discharge amount hereinafter) ejected from a nozzle by the bubble and the ejected ink discharge velocity (to be referred to as a discharge velocity hereinafter).

For this reason, a variation of the ink temperature varies the discharge amount and discharge velocity of ink. Furthermore, the variations of the discharge amount and discharge velocity vary the density in an image, resulting in deterioration in printing quality. Therefore, an ink discharge control technique of discharging ink with consistency regardless of the variation of the ink temperature is necessary to improve the printing quality.

To execute ink discharge control, it is necessary to correctly grasp the ink temperature. Since, however, it is difficult to directly detect the ink temperature, it is common practice to detect the temperature (to be referred to as the head temperature hereinafter) of a head substrate, and execute ink discharge control and head temperature adjustment control based on the detected temperature. To detect the head temperature, it is common practice to use a diode sensor (to be referred to as a Di sensor hereinafter) that is formed on the same silicon substrate as that of a discharge heater. If the Di sensor is used, the temperature is detected using the fact that the output voltage of the Di sensor can be expressed as a linear function of an input temperature. However, the slope and intercept of the linear function include a manufacturing variation.

Since the output voltage of the Di sensor is weak, it is common practice to improve the resolution by amplifying the output voltage by the printing apparatus before A/D conversion. However, since an amplification circuit also includes a manufacturing variation, the voltage value before A/D conversion largely varies.

Therefore, to obtain the correct head temperature, it is necessary to calibrate the variation. According to Japanese Patent Laid-Open No. 2013-006337, assuming that the slope component of the manufacturing variation of the output characteristic of a Di sensor can be suppressed, calibration is performed for the intercept component of the manufacturing variation and the intercept component of the manufacturing variation of an amplification circuit, using offset correction values. Furthermore, there is proposed a method of performing calibration of the Di sensor by appropriately executing calibration control of comparing the environment temperature and the output temperature of the Di sensor after correction and adding the difference amount as an offset correction value.

On the other hand, along with an increase in printing velocity and an increase in resolution of recent printing apparatuses, an ink discharge frequency tends to increase. As a result, the drive frequency of the heater of the printhead increases, and thus the temperature readily varies in a nozzle array direction in which a plurality of nozzles for discharging ink are arrayed. However, in an arrangement in which only one Di sensor is provided on a head substrate, it is impossible to cope with a local temperature change at a position away from the Di sensor. Especially, heater driving when there is no ink in a nozzle corresponding to a discharge heater (to be referred to as non-printing discharge hereinafter), which is caused by running out of ink or entering of a bubble, becomes a big problem.

This is because if non-printing discharge occurs, a heat amount applied from the heater is not consumed by ink discharge, and thus the head temperature excessively rises, causing a difficulty such as stripping of a nozzle. Therefore, the recent printing apparatus includes a plurality of Di sensors on a head substrate to cope with a local temperature change on the head substrate. With respect to each Di sensor used for head temperature detection, it is possible to acquire correct temperature information by applying the calibration method disclosed in Japanese Patent Laid-Open No. 2013-006337.

However, if an amplification circuit is added to each Di sensor, the device cost increases accordingly. In addition, the cost for providing an arrangement of confirming the manufacturing variation of the amplification circuit and the manufacturing variation of the intercept of the linear function used to detect the temperature of the Di sensor and storing an offset correction value also increases. Since these costs increase for each Di sensor, these costs increase more conspicuously as the number of Di sensors increases.

SUMMARY OF THE INVENTION

Accordingly, the present invention is conceived as a response to the above-described disadvantages of the conventional art.

For example, a printing apparatus and a head temperature correction method according to this invention are capable of easily correcting a plurality of temperature detection elements at low cost.

According to one aspect of the present invention, there is provided a printing apparatus comprising: a printhead including a plurality of print elements for generating energy used for printing an image on a print medium, a first temperature detection element and a second temperature detection element at positions different in a direction of a print element array in which the plurality of print elements are arrayed; a first correction unit configured to correct a signal concerning a head temperature based on an output from the first temperature detection element; and a second correction unit configured to correct, based on the signal concerning the head temperature corrected by the first correction unit, a signal concerning a head temperature output from the second temperature detection element.

According to another aspect of the present invention, there is provided a method of correcting a head temperature detected by a printing apparatus including a printhead with a plurality of print elements for generating energy used for printing an image on a print medium, a first temperature detection element and a second temperature detection element at positions different in a direction of a print element array in which the plurality of print elements are arrayed, the method comprising: correcting a signal concerning a head temperature based on an output from the first temperature detection element; and correcting, based on the corrected signal concerning the head temperature, a signal concerning a head temperature output from the second temperature detection element.

The invention is particularly advantageous since it is possible to easily correct a plurality of temperature detection elements at low cost.

Further features of the present invention will become apparent from the following description of exemplary embodiments (with reference to the attached drawings).

DESCRIPTION OF THE EMBODIMENTS

Figure 1A:
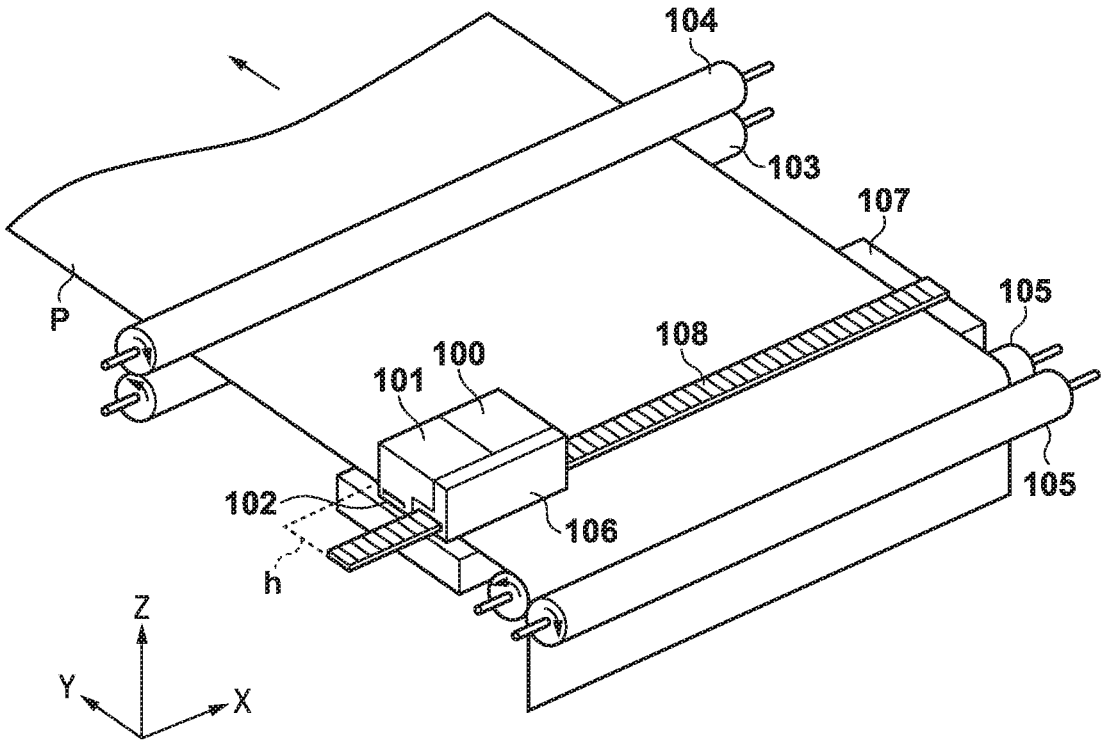
FIGS. 1A and 1B are a perspective view and a sectional view each showing an outline of the arrangement of a printing apparatus including printheads for executing printing in accordance with an inkjet method according to an exemplary embodiment of the present invention.

Exemplary embodiments of the present invention will now be described in detail in accordance with the accompanying drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "on the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Explanation of Outline of Printing Apparatus (FIGS. 1A to 3)>

Figure 1B:
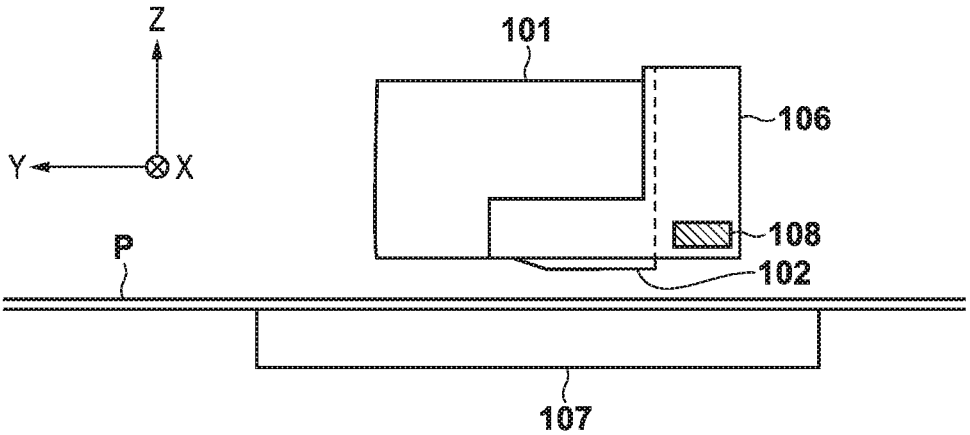

FIGS. 1A and 1B are a perspective view and a sectional view each showing an outline of the arrangement of a printing apparatus including inkjet printheads according to an exemplary embodiment of the present invention. FIG. 1A is a perspective view of the printing apparatus. FIG. 1B is a Y-Z sectional view passing through the printhead in FIG. 1A.

Referring to FIGS. 1A and 1B, reference numerals 100 and 101 denote printheads each integrated with an ink tank. The printhead 100 contains cyan ink, magenta ink, and yellow ink in the ink tanks, and the printhead 101 contains black ink in the ink tank. Each of the printheads 100 and 101 includes a plurality of ink orifices (to be referred to as orifices hereinafter) 102 arrayed in correspondence with each color ink. Reference numeral 103 denotes a conveyance roller; and 104, an auxiliary roller. These rollers respectively rotate in the directions of arrows in FIG. 1A in cooperation with each other while pressing a print medium P, thereby intermittently conveying the print medium P in the Y direction. Reference numeral 105 denotes a feeding roller that feeds the print medium P, and also plays a role in pressing the print medium P, similar to the conveyance roller 103 and the auxiliary roller 104. Reference numeral 106 denotes a carriage that supports the printheads 100 and 101, and reciprocally moves them in the X direction along with printing. While no printing is executed or when performing a recovery operation of the printhead or the like, the carriage 106 stands by at a home position h indicated by a dotted line in FIG. 1A. Reference numeral 107 denotes a platen that plays a role in stably supporting the print medium P at a print position. Reference numeral 108 denotes a carriage belt that scans the carriage 106 in the X direction.

Figure 2A:
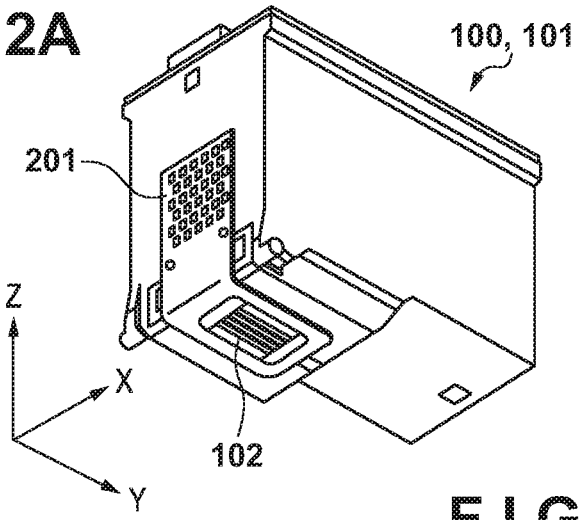
FIGS. 2A, 2B, 2C, 2D, and 2E are schematic views each showing the arrangement of the printhead amounted on the printing apparatus shown in FIGS. 1A and 1B.
Figure 2B:
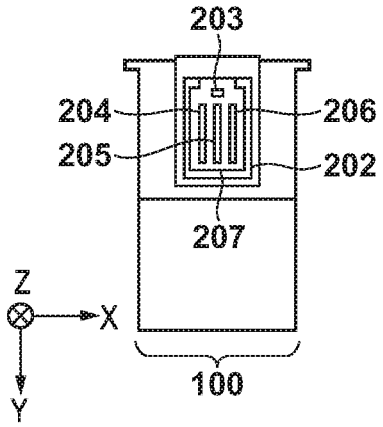
Figure 2C:
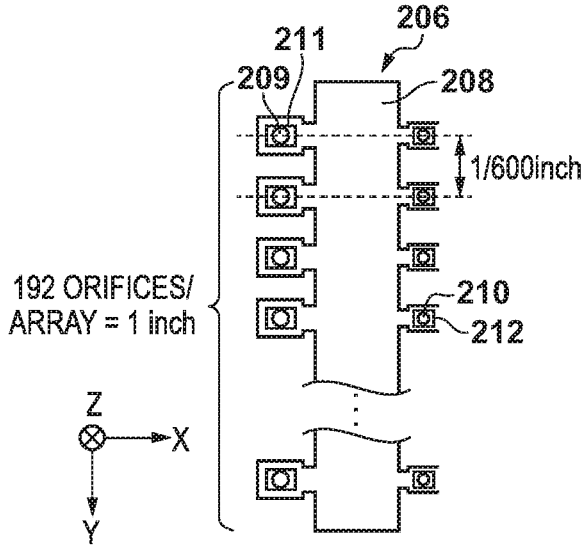
Figure 2D:
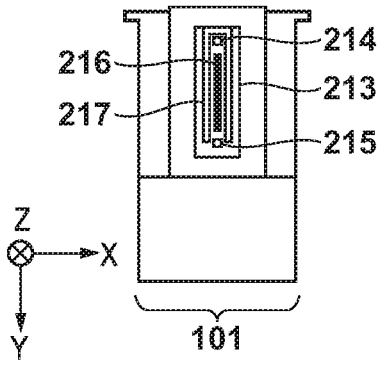
Figure 2E:
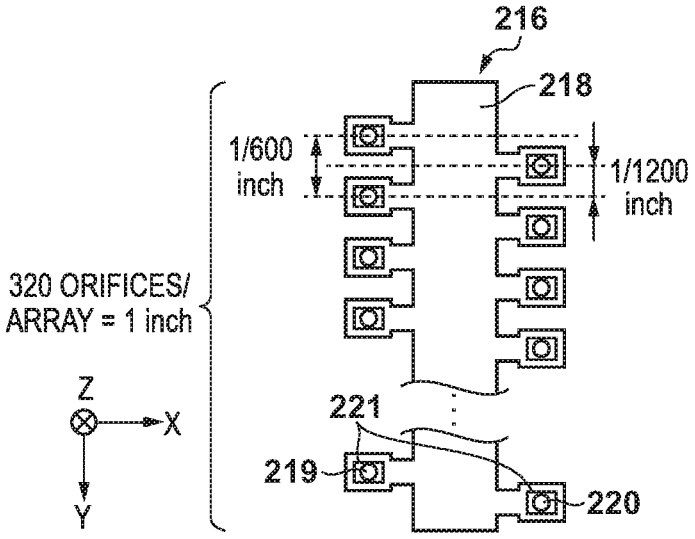

FIGS. 2A to 2E are views each showing the arrangement of the printhead. FIG. 2A is a perspective view showing the printhead 100 or 101. FIG. 2B is a bottom view when viewing the printhead 100 in the Z direction. FIG. 2C is an enlarged view showing a portion in the periphery of orifices in FIG. 2B. FIG. 2D is a bottom view when viewing the printhead 101 in the Z direction. FIG. 2E is an enlarged view showing a portion in the periphery of orifices in FIG. 2D.

An arrangement common to the printheads 100 and 101 will be described first. In FIG. 2A, reference numeral 201 denotes a contact pad via which a print signal is received from the main body of the printing apparatus and power necessary for driving of the printhead is supplied. A portion having a different arrangement for each of the printheads 100 and 101 will be described below.

In FIG. 2B, reference numeral 202 denotes a head substrate; 203, a temperature detection element (diode sensor (Di sensor)) that detects a printhead temperature (the temperature of the head substrate); 204, an orifice array that discharges yellow ink; 205, an orifice array that discharges magenta ink; and 206, an orifice array that discharges cyan ink. The orifice arrays 204, 205, and 206 have the same orifice structure and the like except ink color. Furthermore, reference numeral 207 denotes an ink heating sub-heater that surrounds the orifice arrays 204, 205, and 206, and heats or does not heat the head substrate in accordance with whether a voltage is applied.

FIG. 2C is an enlarged view of the orifice array 206 that discharges cyan ink. Reference numeral 208 denotes an ink liquid chamber in which cyan ink flows. On two sides of the ink liquid chamber 208, there exist orifices 209 that discharge 5-pl ink and orifices 210 that discharge 2-pl ink. A 5-pl discharge heater 211 or a 2-pl discharge heater 212 is arranged immediately below (in the +Z direction) each nozzle. The number of formed orifices 209 or 210 is 192 and the interval between the orifices is 1/600 inch. It is thus configured so that a printing pixel density is 600 dpi.

In FIG. 2D, reference numeral 213 denotes a head chip; 214 and 215, Di sensors each for detecting a printhead temperature; 216, an orifice array that discharges black ink; and 217, a sub-heater.

FIG. 2E is an enlarged view of the orifice array 216 that discharges black ink. Reference numeral 218 denotes an ink liquid chamber of black ink. On two sides of the ink liquid chamber 218, there exist orifices 219 and 220 that discharge 12-pl ink. A 12-pl discharge heater 221 is arranged immediately below (in the +Z direction) each nozzle. The number of formed orifices 219 or 220 is 320 and the interval between the orifices is 1/600 inch. In addition, the orifices 219 and 220 are shifted in the Y direction by 1/1200 inch. It is thus configured so that a printing pixel density is 1,200 dpi.

In the printhead 101, the temperature readily varies in the orifice array direction (Y direction) since the number of orifices is larger than that in the printhead 100 and the heat amount applied from the heater is also larger than in the printhead 100 because of a larger ink discharge amount. The printhead 101 includes the two Di sensors 214 and 215 to cope with a local temperature change.

In addition to ink discharge, each of the heaters 211, 212, and 221 can warm up ink by being applied with a driving pulse that does not discharge ink. Such temperature-retention control will be referred to as short pulse heating control hereinafter. This printing apparatus adjusts the printhead temperature by short pulse heating control and control of the sub-heater. Furthermore, the printing apparatus performs feedback control by switching heating/non-heating of the head substrate so that the temperature of the head substrate becomes close to a target temperature based on temperature measurement by the diode sensors 203 and 214.

Figure 3:
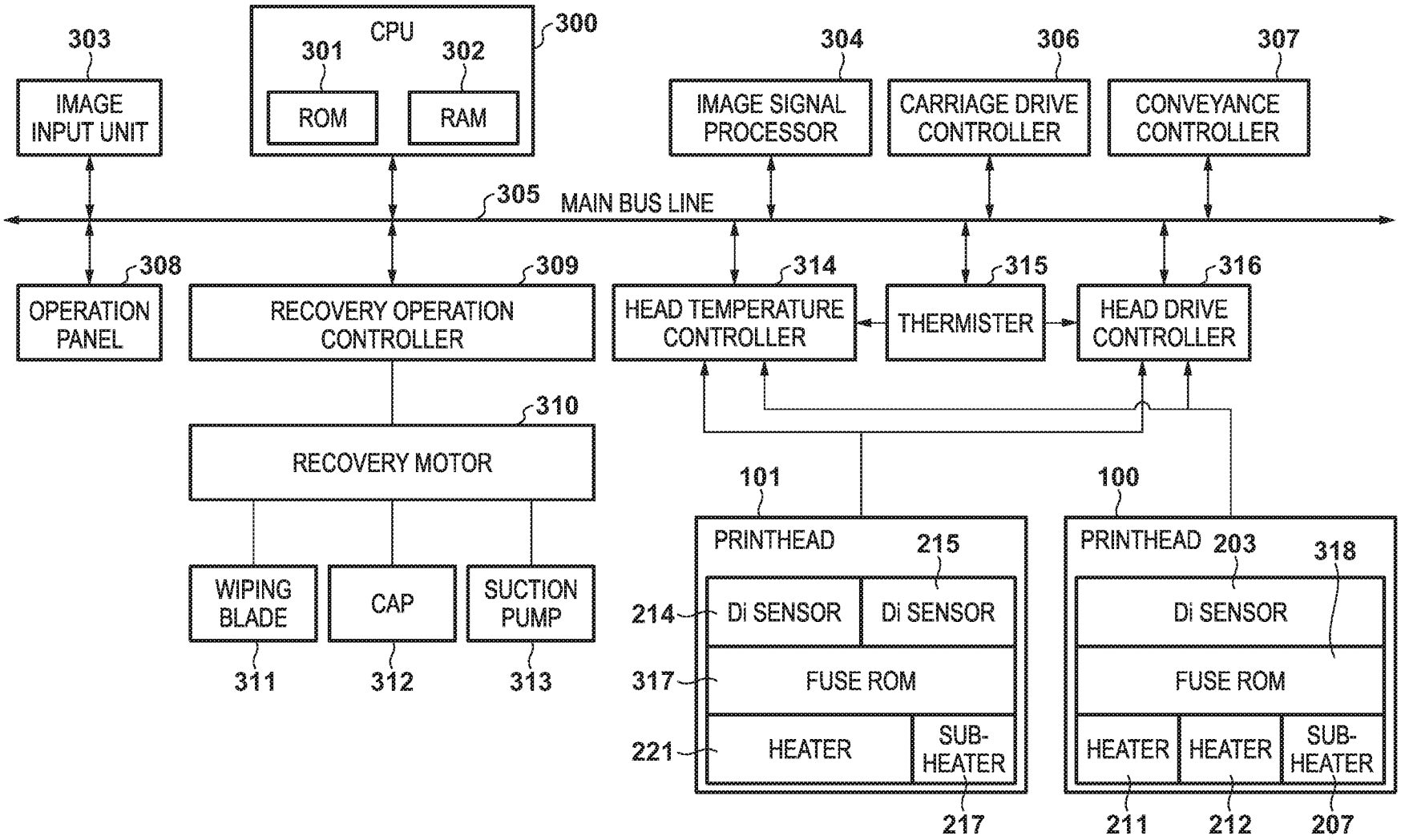
FIG. 3 is a block diagram showing the control arrangement of the printing apparatus shown in FIGS. 1A and 1B.

FIG. 3 is a block diagram showing the control arrangement of the printing apparatus shown in FIGS. 1A and 1B.

Components of the control arrangement are roughly classified into a control unit (software control unit) using software and a control unit (hardware control unit) using hardware. The software control unit includes components such as an image input unit 303, a corresponding image signal processor 304, and a CPU 300, each of which accesses a main bus line 305. The hardware control unit includes components such as an operation panel 308, a recovery operation controller 309, a head temperature controller 314, a head drive controller 316, a carriage drive controller 306 in the main scanning direction (X direction), and a conveyance controller 307 in the sub-scanning direction (Y direction).

The CPU 300 includes a ROM 301 and a RAM 302, and executes printing by imposing proper print conditions on input information and driving the ink discharge heaters 211, 212, and 221 in the printheads 100 and 101. The ROM 301 stores in advance a program for executing the recovery timing chart of the printhead, and imposes recovery conditions such as preliminary discharge conditions on the recovery operation controller 309, the printheads 100 and 101, and the like, as needed. A recovery motor 310 drives the printheads 100 and 101, and a wiping blade 311, a cap 312 and a suction pump 313, which face the printheads 100 and 101 and are separated from them. The head temperature controller 314 determines the driving condition of the sub-heater 207 or 217 of the printhead 100 or 101 based on the output value of a thermistor 315 that detects the environment temperature as the temperature in the periphery of each printhead and the output value of the Di sensor 203 or 214 that detects the printhead temperature.

The head drive controller 316 drives the sub-heaters 207 and 217 based on the determined driving conditions. The head drive controller 316 also drives the discharge heaters 211, 212, and 221 on the printheads 100 and 101. By driving the heaters 211, 212, and 221, the printheads 100 and 101 are made to perform preliminary discharge, ink discharge, and ink temperature adjustment for temperature adjustment control. A program for executing temperature adjustment control is stored in, for example, the ROM 301, and detection of the printhead temperature and driving of the sub-heater 207 or 217 are executed via the head temperature controller 314 and the head drive controller 316.

Note that the head drive controller 316 performs PWM control by driving each of the heaters 211, 212, and 221 by a driving signal formed from a pre-pulse and a main pulse. Each of fuse ROMs 317 and 318 stores the characteristic value of each printhead in accordance with a combination of cut/uncut of fuses. Stored printhead characteristics are roughly classified into characteristics written in the manufacturing process of the printhead and characteristics written on the printing apparatus.

Embodiments concerning detection of the printhead temperature executed by the printing apparatus having the above arrangement will be described below. In each embodiment, the Di sensors 214 and 215 on the printhead 101 will be referred to as MainDi and SubDi, respectively. The Di sensor 203 on the printhead 100 acquires the head temperature by the same method as that for MainDi 214 of the printhead 101 and a description thereof will be omitted.

First Embodiment

Figure 4:
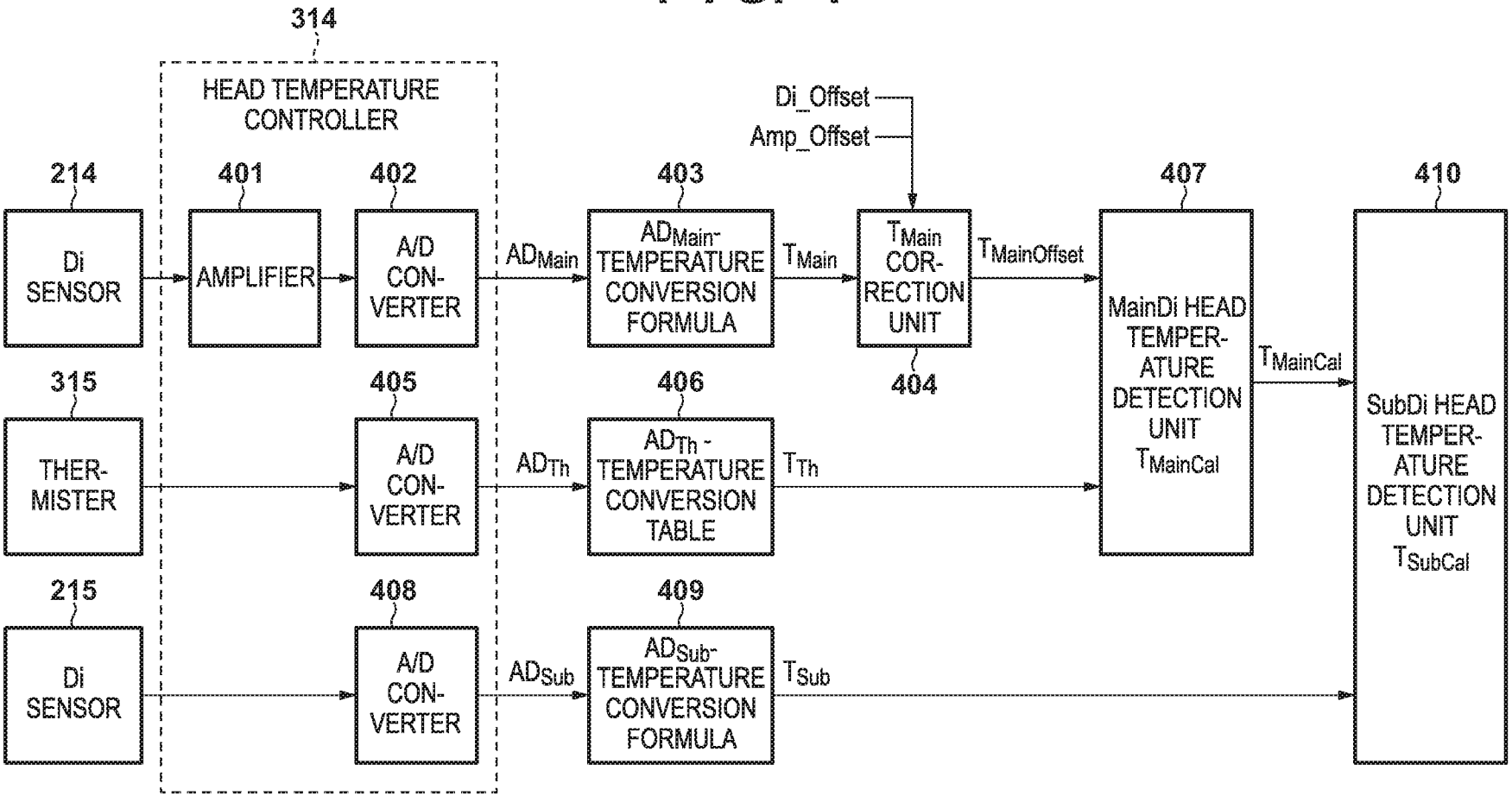
FIG. 4 is a block diagram showing the processing flow of a head temperature control circuit of the printing apparatus shown in FIGS. 1A and 1B.

FIG. 4 is a block diagram showing the flow of processing in a head temperature controller 314 using a program stored/loaded in a ROM 301/RAM 302.

Since the output temperature of MainDi 214 is used to adjust a head temperature, it is necessary to perform head temperature detection with higher accuracy/higher resolution. On the other hand, as described above, since the main purpose of SubDi 215 is to detect a local temperature change at the time of non-printing discharge, a resolution as high as that of MainDi is not required as long as it is possible to ensure predetermined accuracy. For this reason, signal amplification by an amplifier 401 is performed only for MainDi 214.

As shown in FIG. 4, if a voltage based on the head temperature is input from MainDi 214 of a printhead 101 to the head temperature controller 314, the amplifier 401 amplifies the input voltage, and an A/D converter 402 converts the voltage value into a digital signal. A voltage value $AD_{Main}$ of the digital signal is converted into a temperature $T_{Main}$ by an $AD_{Main}$-temperature conversion formula 403 stored in the ROM 301. A $T_{Main}$ correction unit 404 corrects the manufacturing variations of the amplifier and the Di sensor with respect to the temperature $T_{Main}$. An offset correction value Di_Offset of the Di sensor and an offset correction value Amp_Offset of the amplifier are added to $T_{Main}$, thereby deriving a corrected temperature $T_{MainOffset}$. Di_Offset is a correction value for the manufacturing variation of the Di sensor, and is a characteristic value of a head written in a fuse ROM 317 in the manufacturing stage of the head.

Table 1 is a table showing an example of ranking the offset correction value of the manufacturing variation of Di sensor stored in a printhead.

TABLE 1

| Diode sensor rank | Bit representation | Offset error Di_offset |
|---|---|---|
| 0 | 0000 | −16° C. ≤ Di_offset ≤ −14° C. |
| 1 | 0001 | −14° C. ≤ Di_offset ≤ −12° C. |
| 2 | 0010 | −12° C. ≤ Di_offset ≤ −10° C. |
| 3 | 0011 | −10° C. ≤ Di_offset ≤ −8° C. |
| 4 | 0100 | −8° C. ≤ Di_offset ≤ −6° C. |
| 5 | 0101 | −6° C. ≤ Di_offset ≤ −4° C. |
| 6 | 0110 | −4° C. ≤ Di_offset ≤ −2° C. |
| 7 | 0111 | −2° C. ≤ Di_offset ≤ 0° C. |
| 8 | 1000 | 0° C. ≤ Di_offset ≤ +2° C. |
| 9 | 1001 | +2° C. ≤ Di_offset ≤ +4° C. |
| 10 | 1010 | +4° C. ≤ Di_offset ≤ +6° C. |
| 11 | 1011 | +6° C. ≤ Di_offset ≤ +8° C. |
| 12 | 1100 | +8° C. ≤ Di_offset ≤ +10° C. |
| 13 | 1101 | +10° C. ≤ Di_offset ≤ +12° C. |
| 14 | 1110 | +12° C. ≤ Di_offset ≤ +14° C. |
| 15 | 1111 | +14° C. ≤ Di_offset ≤ +16° C. |

Table 1 shows an example of ranking Di_Offset with an error of ±16° C. for 4 bits.

In the example shown in Table 1, the Di sensor of the same rank outputs an offset error within an error range of 2° C. If a voltage based on the environment temperature of the printing apparatus is input from a thermistor 315 to the head temperature controller 314, an A/D converter 405 converts the voltage into a digital signal. A digital thermistor voltage value $AD_{Th}$ is converted into a thermistor temperature $T_{Th}$ by an $AD_{Th}$-temperature conversion table 406 stored in the ROM 301.

The thus obtained corrected temperature $T_{MainOffset}$ and thermistor temperature $T_{Th}$ are input to a MainDi head temperature detection unit 407. The MainDi head temperature detection unit 407 sets an offset value of the corrected temperature $T_{MainOffset}$ using the thermistor temperature $T_{Th}$. A head temperature $T_{MainCal}$ by MainDi is thus acquired.

On the other hand, if a voltage based on the head temperature is input from SubDi 215 to the head temperature controller 314, an A/D converter 408 converts the voltage value into a digital signal. A voltage value $AD_{Sub}$ of the digital signal is converted into a temperature $T_{Sub}$ by an $AD_{Sub}$-temperature conversion formula 409 stored in the ROM 301. Then, the temperature $T_{Sub}$ is input to a SubDi head temperature detection unit 410. The SubDi head temperature detection unit 410 sets the offset value of the temperature $T_{Sub}$ using the head temperature $T_{MainCal}$, thereby acquiring the head temperature $T_{MainCal}$ by SubDi.

Figure 5A:
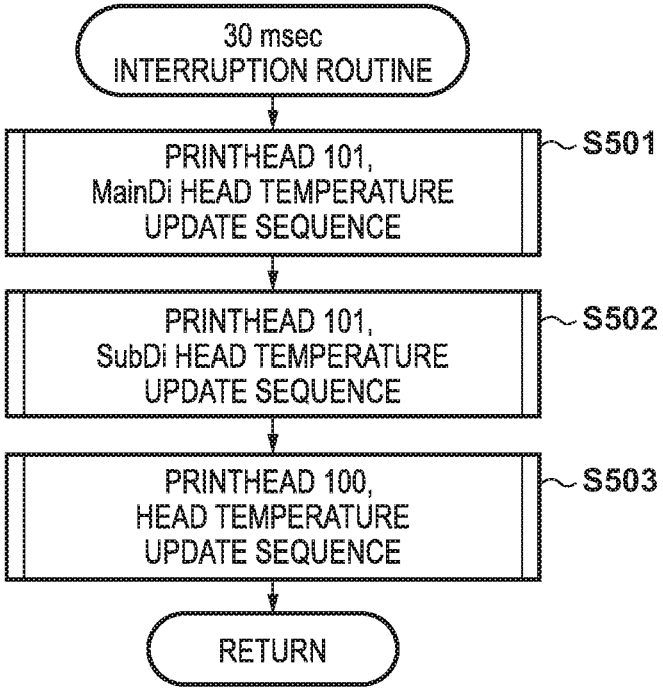
FIGS. 5A, 5B, and 5C are flowcharts illustrating the processing procedure of the head temperature control circuit of the printing apparatus shown in FIGS. 1A and 1B.
Figure 5B:
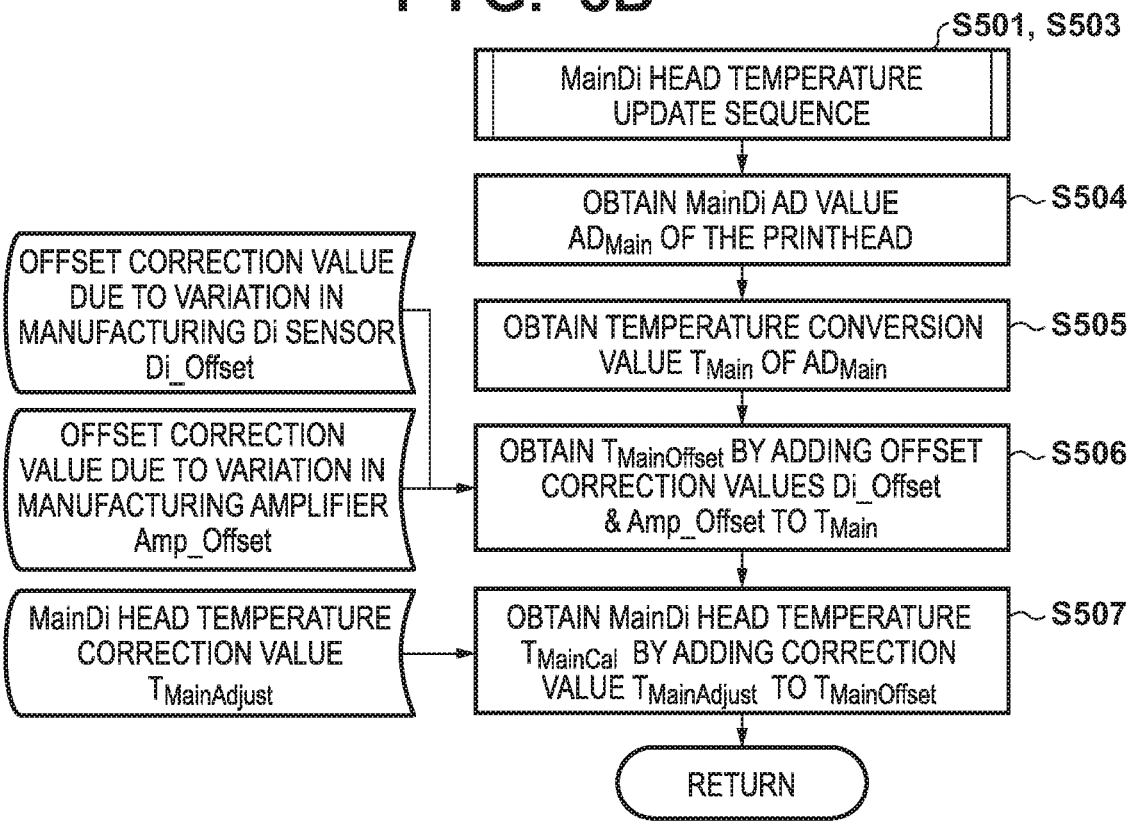
Figure 5C:
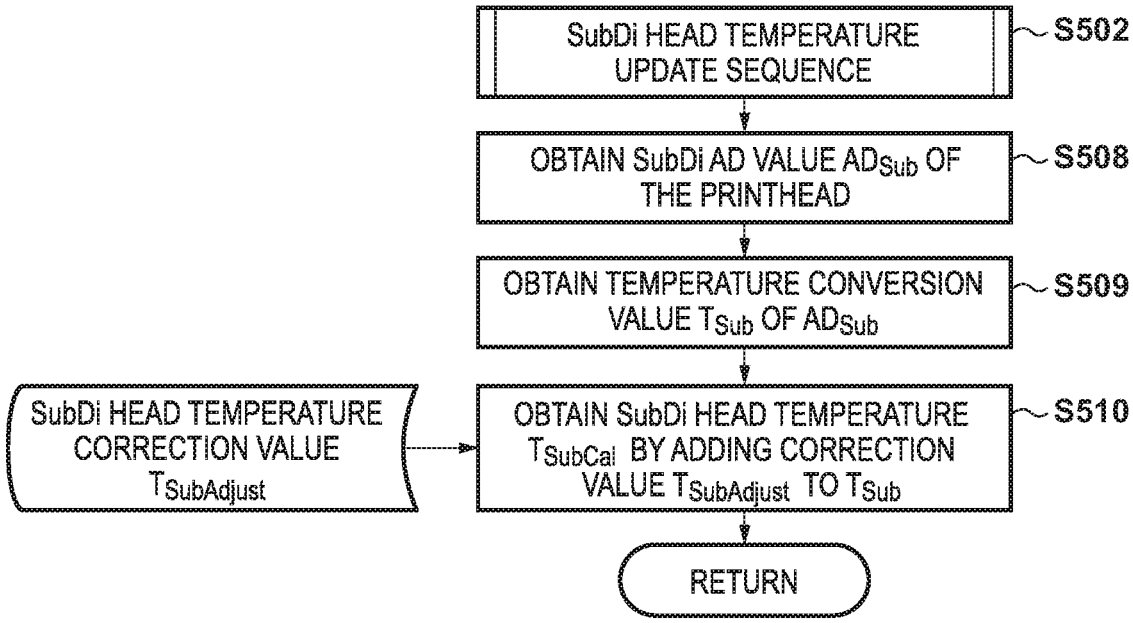

FIGS. 5A to 5C are flowcharts illustrating the head temperature acquisition method for MainDi and SubDi of the printhead. FIG. 5A shows an outline of the processing of a head temperature update routine that interrupts at an interval of 30 ms. FIG. 5B shows the head temperature update sequence of MainDi 214. FIG. 5C shows the head temperature update sequence of SubDi 215.

When the printing apparatus is powered on, as shown in FIG. 5A, an interruption routine is activated at an interval of 30 ms, and the head temperature is updated in order of steps S501, S502, and S503. Note that as described above, the head temperature update sequence S503 of a printhead 100 is the same as the head temperature update sequence S501 by MainDi of the printhead 101 and a description thereof will be omitted.

Details of Head Temperature Update Sequence of MainDi 214 (FIG. 5B)

In step S501, the head temperature by MainDi 214 of the printhead 101 is updated. Referring to FIG. 5B, in step S504, based on an output from MainDi 214 of the printhead 101 the digital signal value $AD_{Main}$ of MainDi is acquired.

In step S505, the digital signal value $AD_{Main}$ is converted into the temperature $T_{Main}$ by the $AD_{Main}$-temperature conversion formula 403 stored in the ROM 301. In step S506, the manufacturing variation of the Di sensor and that of the amplification circuit are corrected. That is, the offset correction value Di_Offset of MainDi 214 and the offset correction value Amp_Offset of the amplifier 401 are added to the temperature $T_{Main}$, thereby deriving $T_{MainOffset}$. At this time, in accordance with the Di sensor rank written in a fuse ROM 317 of the printhead, a corresponding value in Table 1 is applied to Di_Offset.

Table 2 is a table showing an example of ranking the offset correction value of the manufacturing variation of the amplifier stored in the main body of the printing apparatus.

TABLE 2

| Amplifier rank | Bit representation | Offset error Amp_offset |
|---|---|---|
| 0 | 000 | −8° C. ≤ Amp_offset ≤ −6° C. |
| 1 | 001 | −6° C. ≤ Amp_offset ≤ −4° C. |
| 2 | 010 | −4° C. ≤ Amp_offset ≤ −2° C. |

TABLE 2-continued

| Amplifier rank | Bit representation | Offset error Amp_offset |
|---|---|---|
| 3 | 011 | −2° C. ≤ Amp_offset ≤ 0° C. |
| 4 | 100 | 0° C. ≤ Amp_offset ≤ +2° C. |
| 5 | 101 | +2° C. ≤ Amp_offset ≤ +4° C. |
| 6 | 110 | +4° C. ≤ Amp_offset ≤ +6° C. |
| 7 | 111 | +6° C. ≤ Amp_offset ≤ +8° C. |

In accordance with the amplifier rank written in the ROM 301 of the printing apparatus, a corresponding value in Table 2 is applied to Amp_Offset.

In step S507, a head temperature correction value $T_{MainAdjust}$ of MainDi 214 is added to $T_{MainOffset}$ to acquire the head temperature $T_{MainCal}$ of MainDi 214. Note that a method of acquiring $T_{MainAdjust}$ will be described later.

Details of Head Temperature Update Sequence of SubDi 215 (FIG. 5C)

In step S502, the head temperature by SubDi 215 of the printhead 101 is updated. Referring to FIG. 5C, in step S508, based on an output from SubDi 215 of the printhead 101 the digital signal value $AD_{Sub}$ of SubDi is acquired.

In step S509, the digital signal value $AD_{Sub}$ is converted into the temperature $T_{Sub}$ by the $AD_{Sub}$-temperature conversion formula 409 stored in the ROM 301. In step S510, a head temperature correction value $T_{SubAdjust}$ of SubDi 215 is added to the temperature $T_{Sub}$ to acquire a head temperature $T_{SubCal}$ of SubDi 215. Note that a method of acquiring $T_{SubAdjust}$ will be described later.

The head temperature $T_{MainCal}$ of MainDi 214 and the head temperature $T_{subCal}$ of SubDi 215 are updated for every 30 ms, and used for head temperature adjustment control, head protection control, and the like.

The method of acquiring the head temperature correction value $T_{MainAdjust}$ of MainDi 214 and the method of acquiring the head temperature correction value $T_{SubAdjust}$ of SubDi 215 will be described next.

Figure 6A:
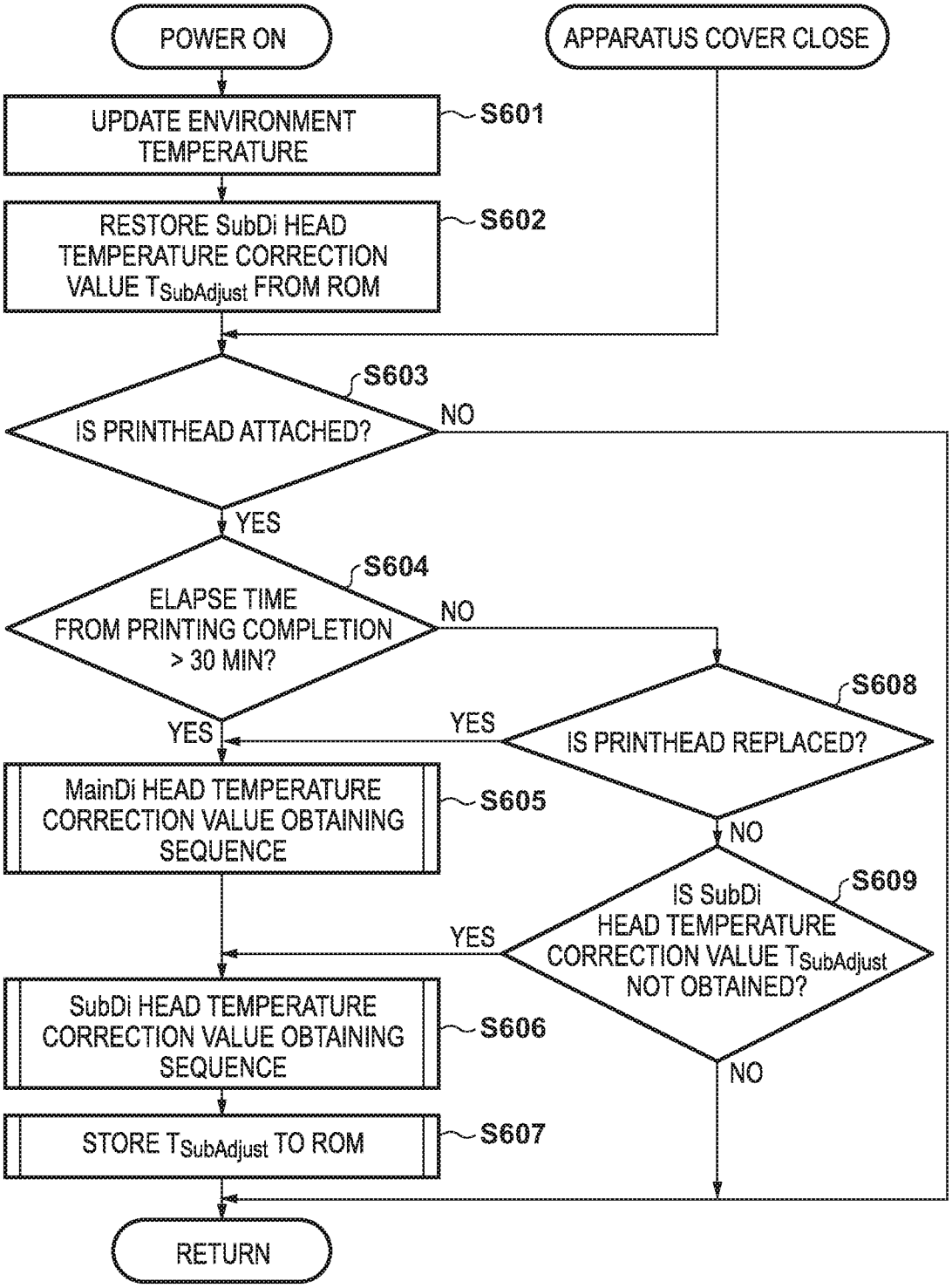
FIGS. 6A and 6B are flowcharts respectively illustrating processes of acquiring head temperature correction values according to the first embodiment.
Figure 6B:
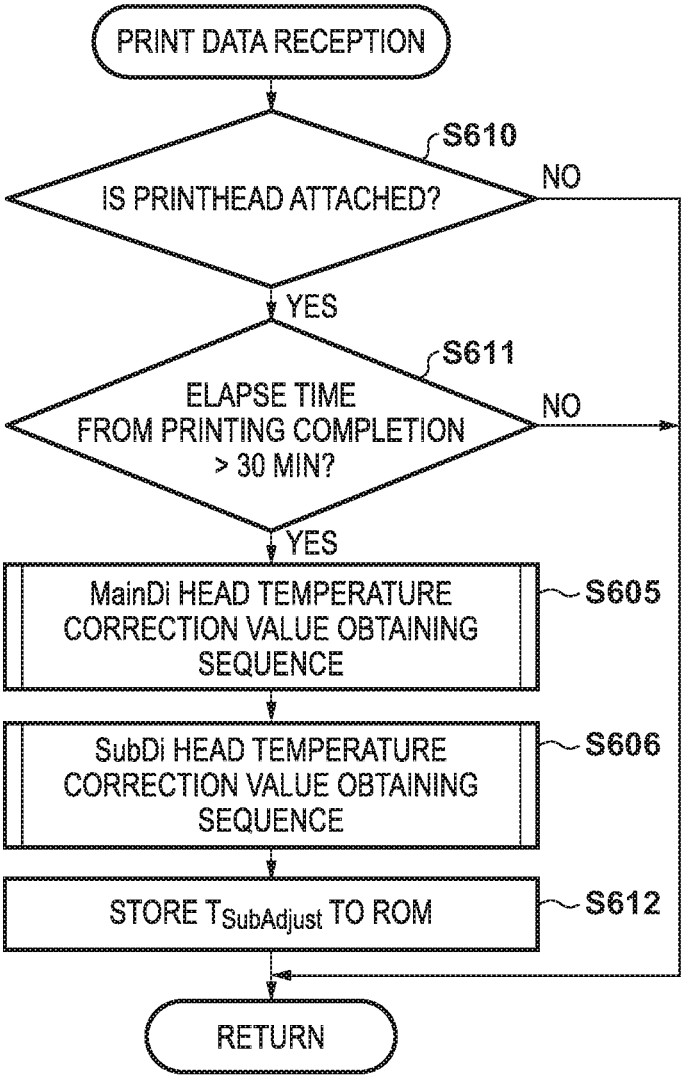

FIGS. 6A and 6B are flowcharts respectively illustrating processes of acquiring the head temperature correction values of MainDi and SubDi. As described above, processing for the Di sensor 203 of the printhead 100 is the same as that for MainDi 214 of the printhead 101, and a description thereof will be omitted.

A timing of acquiring each correction value is desirably a timing at which each temperature is equal to a comparison target. For $T_{MainAdjust}$, a timing at which the head temperature of MainDi 214 is equal to the thermistor temperature is optimum. On the other hand, for the head temperature correction value of SubDi 215, a timing at which the head temperature of SubDi 215 is equal to that of MainDi 214 is optimum. Furthermore, to correctly acquire the head temperature of MainDi, a timing after acquiring $T_{MainAdjust}$ is desirable.

As described in Japanese Patent Laid-Open No. 2013-006337, even if there is a deviation between the environment temperature and the head temperature, it is possible to reduce the error of the head temperature by pre-correction by the sensor rank of MainDi and the amplifier rank.

However, as long as the environment temperature is not equal to the head temperature at the timing of acquiring the head temperature correction value, the error still remains. Thus, it is necessary to acquire the head temperature correction value again at a timing at which the temperatures are equal to each other. An example of the timing at which the head temperature of MainDi is equal to the thermistor temperature is a timing immediately after the power is turned on or the head is replaced.

To replace the printhead while the power is ON, it is necessary to open/close the cover of the printing apparatus. Therefore, as shown in FIG. 6A, the head temperature correction value acquisition procedure starts at the time of closing the cover of the printing apparatus in addition to the time of power-on. As shown in FIG. 6B, by providing a start point before the start of printing, the head temperature correction value is acquired again. Since MainDi and SubDi are provided on the same substrate, the temperatures become equal to each other within a time much shorter than a time taken until the temperatures of MainDi and the thermistor become equal to each other. Therefore, the update timing of the head temperature correction value of SubDi is preferably immediately after the head temperature correction value of MainDi is updated.

Note that if an attempt is made to acquire the head temperature correction value immediately after a print operation, the printhead carries heat, and thus there is a deviation between the environment temperature and the head temperature. Therefore, it is important to determine whether a sufficient time has elapsed since a discharge operation, and acquire the head temperature correction value in a state in which the head temperature is closer to the environment temperature.

<Acquisition of Head Temperature Correction Value at Power-on or at Time of Closing Cover of Apparatus>

Referring to FIG. 6A, if the printing apparatus is powered on, the environment temperature is updated in step S601. More specifically, the MainDi head temperature detection unit 407 acquires the thermistor temperature $T_{Th}$, sets it as an environment temperature Tenv, and stores it in the RAM 302. In step S602, the head temperature correction value $T_{SubAdjust}$ of SubDi is restored from the ROM 301. In this embodiment, if $T_{SubAdjust}$ is not written in the ROM 301, it is considered that $T_{SubAdjust}$ has not been acquired. In step S603, it is checked whether the printhead has already been attached. If it is determined that the printhead has not been attached, the process ends without acquiring the temperature correction value; otherwise, the process advances to step S604.

In step S604, it is checked whether an elapsed time exceeds 30 min since the end of printing. If the elapsed time exceeds 30 min, it is determined that the head temperature fits in with the environment temperature, and the process advances to step S605 to execute the head temperature correction value acquisition sequence of MainDi. On the other hand, if the elapsed time is shorter than 30 min, it is determined that the head temperature is highly probably higher than the environment temperature, and the process advances to step S608. In step S608, it is checked whether the printhead has been replaced. If the printhead has been replaced, it is considered that the head temperature of the replaced printhead fits in with the environment temperature, and thus the process advances to step S605 to execute the head temperature correction value acquisition sequence of MainDi. On the other hand, if the printhead has not been replaced, the process advances to step S609.

In step S609, it is checked whether the head temperature correction value $T_{SubAdjust}$ of SubDi has not been acquired. If it is determined that $T_{SubAdjust}$ has not been acquired, the process advances to S606 to execute the head temperature correction value acquisition sequence of SubDi. Then, $T_{SubAdjust}$ is acquired. After acquiring the head temperature correction value $T_{SubAdjust}$ of SubDi, the process advances to step S607 to write acquired $T_{SubAdjust}$ in the ROM 301. On the other hand, if it is determined that $T_{SubAdjust}$ has been acquired, the process ends without acquiring the head temperature correction value.

The above processing is summarized, as follows:

(1) If the elapsed time since the end of printing exceeds 30 min, or even if the elapsed time is shorter than 30 min but if the printhead is replaced, the head temperature correction value acquisition sequence of MainDi and the head temperature correction value acquisition sequence of SubDi are executed;

(2) Even if the elapsed time since the end of printing is shorter than 30 min and the printhead has not been replaced, if $T_{SubAdjust}$ has not been acquired, only the head temperature correction value acquisition sequence of SubDi is executed; and (3) If the printhead has not been attached or $T_{SubAdjust}$ has not been acquired, the process directly ends.

<Acquisition of Head Temperature Correction Value Before Start of Print Operation at Time of Receiving Print Data>

Referring to FIG. 6B, upon receiving print data, processing of acquiring the head temperature correction value again starts before printing. First, in step S610, it is checked whether the printhead has already been attached. If it is determined that the printhead has already been attached, the process advances to step S611; otherwise, the process ends without acquiring the correction value.

In step S611, it is checked whether the elapsed time since the end of printing exceeds 30 min. If the elapsed time exceeds 30 min, it is determined that the head temperature fits in with the environment temperature, and the process executes, in step S605, the head temperature correction value acquisition sequence of MainDi. In step S606, the head temperature correction value acquisition sequence of SubDi is executed. After that, in step S612, acquired $T_{SubAdjust}$ is written in the ROM 301. On the other hand, if the elapsed time is shorter than 30 min, the process ends without acquiring the correction value.

The head temperature correction value acquisition sequence of MainDi in step S605 and the head temperature correction value acquisition sequence of SubDi in step S606 will now be described.

Figure 7A:
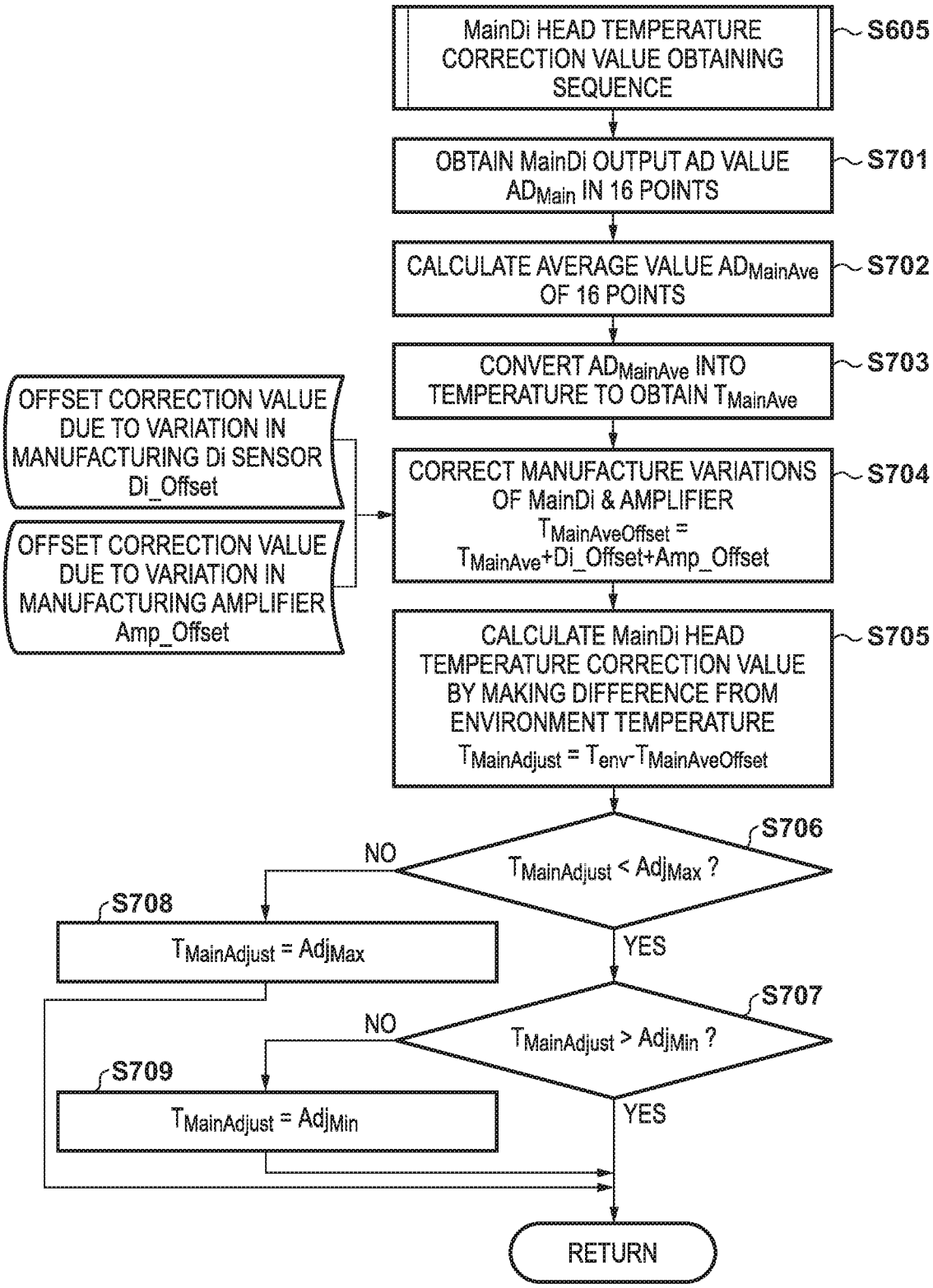
FIGS. 7A and 7B are flowcharts each illustrating a head temperature correction value acquisition sequence for each Di sensor according to the first embodiment.
Figure 7B:
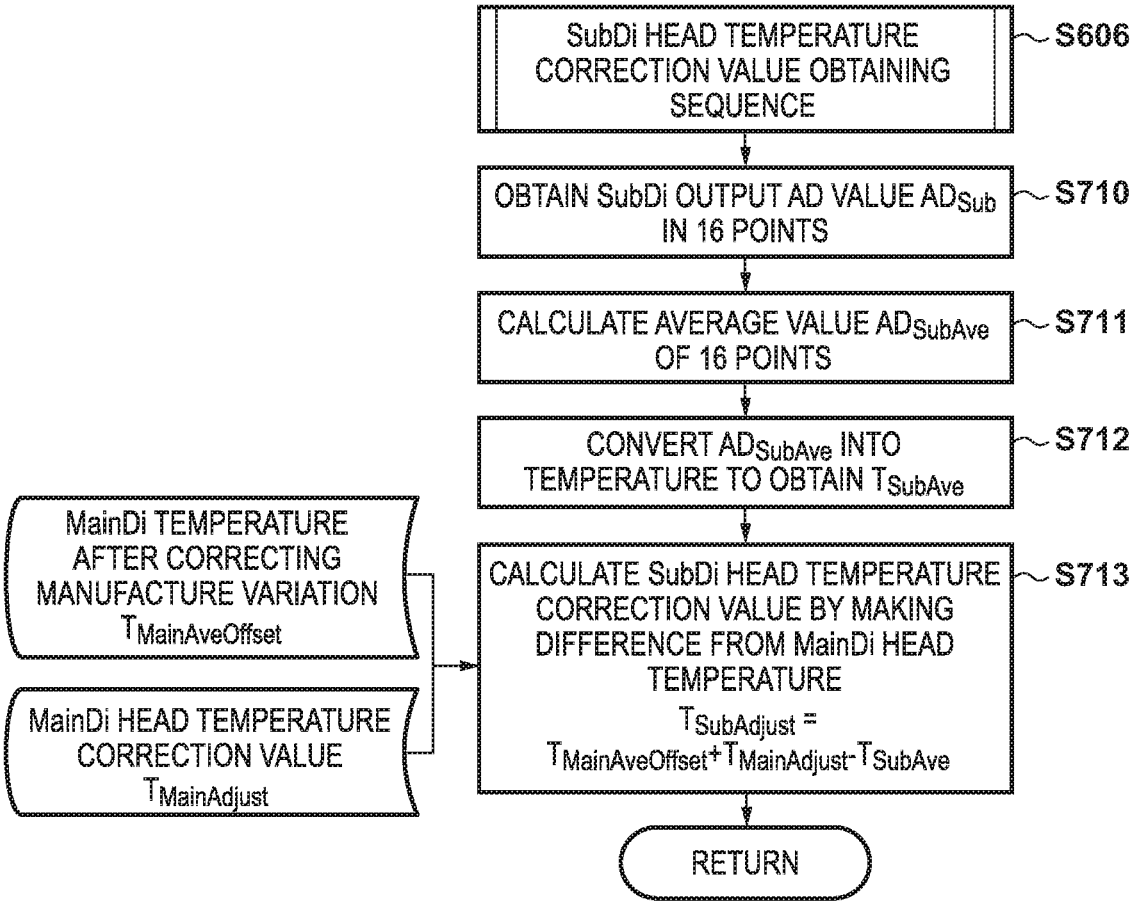

FIGS. 7A and 7B are flowcharts respectively illustrating the head temperature correction value acquisition sequences of MainDi and SubDi. FIG. 7A shows the head temperature correction value acquisition sequence of MainDi. FIG. 7B shows the head temperature correction value acquisition sequence of SubDi.

Acquisition of Head Temperature Correction Value of MainDi (FIG. 7A)

In step S701, 16 digital values $AD_{Main}$ of MainDi 214 are acquired. In step S702, an average value $AD_{MainAve}$ of the acquired 16 digital values is calculated. Acquisition of the 16 digital values is processing for avoiding the influence of electrical noise instantaneously superimposed on the digital signals, and the number of values may be larger than 16.

In step S703, the average value $AD_{MainAve}$ of the digital values is converted into an average temperature $T_{MainAve}$ of MainDi by the $AD_{Main}$-temperature conversion formula 403. In step S704, to correct the manufacturing variation of MainDi and that of the amplifier, the offset correction value Di_Offset and the offset correction value Amp_Offset of the amplifier are added. Thus, an average corrected temperature $T_{MainAveOffset}$ of MainDi is derived.

In step S705, the head temperature correction value $T_{MainAdjust}$ of MainDi is derived from the difference between the environment temperature Tenv and the average corrected temperature $T_{MainAveOffset}$. At this time, if the environment temperature and the head temperature are not sufficiently close to each other, an expectedly large value is input to $T_{MainAdjust}$. To cope with this, in steps S706 to S709, processing of limiting $T_{MainAdjust}$ is executed.

According to Tables 1 and 2, $T_{MainAdjust}$ may deviate from the actual temperature by ±2° C. obtained by adding the error±1° C. in the same rank of the Di sensor and the error±1° C. in the same rank of the amplifier. Therefore, a lower limit correction value $A_{djmin}$ is −2° C., and an upper limit correction value $A_{djMax}$ is +2° C. In step S706, it is checked whether calculated $T_{MainAdjust}$ is smaller than the upper limit correction value $A_{djMax}$. In step S707, it is checked whether calculated $T_{MainAdjust}$ is larger than the lower limit correction value $A_{djMin}$. If $T_{MainAdjust}$ is equal to or larger than the upper limit correction value, the process overwrites $T_{MainAdjust}$ with $A_{djMax}$ in step S708. On the other hand, if $T_{MainAdjust}$ is equal to or smaller than the lower limit correction value, the process overwrites $T_{MainAdjust}$ with $A_{djMin}$ in step S709. Note that if $T_{MainAdjust}$ acquired in step S705 falls within the range of the upper limit correction value and the lower limit correction value, the calculated correction value $T_{MainAdjust}$ is used.

Acquisition of Head Temperature Correction Value of SubDi (FIG. 7B)

In step S710, 16 digital signals $AD_{Sub}$ of SubDi are acquired. In step S711, an average value $AD_{SubAve}$ of the acquired 16 digital values is calculated. Acquisition of the 16 digital signals is more preferably executed simultaneously with acquisition of the digital signals of MainDi in step S701 since the deviation of the acquisition timing becomes smaller.

In step S712, the average digital signal $AD_{SubAve}$ is converted into a temperature $T_{SubAve}$ of SubDi 215 by the $AD_{Sub}$-temperature conversion formula 409. In step S713, the sum of the corrected temperature $T_{MainAveOffset}$ of MainDi acquired in step S704 and $T_{MainAdjust}$ acquired in steps S705 to S709 is calculated. This calculates the head temperature of MainDi. Then, the head temperature correction value $T_{subAjust}$ of SubDi is derived from the difference between the temperature $T_{SubAve}$ of SubDi and the head temperature of MainDi.

Therefore, according to the above-described embodiment, even if the correction value of the manufacturing variation of the Di sensor is not held, it is possible to correct the head temperature acquired from SubDi with the error equal to that for MainDi without amplifying the voltage signal acquired from SubDi.

In this example, the head temperature of MainDi is selected as a comparison target at the time of calculating the head temperature correction value of SubDi. The phenomenon in which the head temperature fits in with the environment temperature occurs due to mainly heat exchange (heat transfer) with the air. However, the phenomenon in which the head temperature of SubDi becomes equal to the head temperature of MainDi, that is, the phenomenon of relaxation of the variation of the temperature in the head occurs due to mainly thermal conduction on the head substrate. In general, temperature relaxation by thermal conduction is a high-speed phenomenon, as compared to temperature relaxation by heat transfer of the air.

Therefore, at the timing of acquiring the head temperature correction value of SubDi, deviation of the temperature between MainDi and SubDi hardly occurs. Thus, the manufacturing variations of the Di sensor and the amplifier can be included in the head temperature correction value $T_{SubAdjust}$ of SubDi without being corrected in advance. For the above reason, in this embodiment, the head temperature correction value $T_{SubAdjust}$ of SubDi is not limited. However, the upper and lower limits may be provided within the error range considered as in steps S705 to S709.

Second Embodiment

In the first embodiment, in correction of MainDi, the manufacturing variation of the Di sensor and that of the amplifier are corrected by offset correction values. In other words, in the first embodiment, if the output characteristic of the Di sensor and that of the amplifier are expressed by linear functions, the manufacturing variations of intercept components of the linear functions are corrected. However, if more accurate temperature detection is required, it is necessary to consider the manufacturing variations of the slope components of the output characteristics of the Di sensor and the amplifier. The second embodiment will describe a correction method that considers the slope component of the output characteristic of an amplifier by assuming that the slope component of the output characteristic of a Di sensor can be suppressed.

Figure 8:
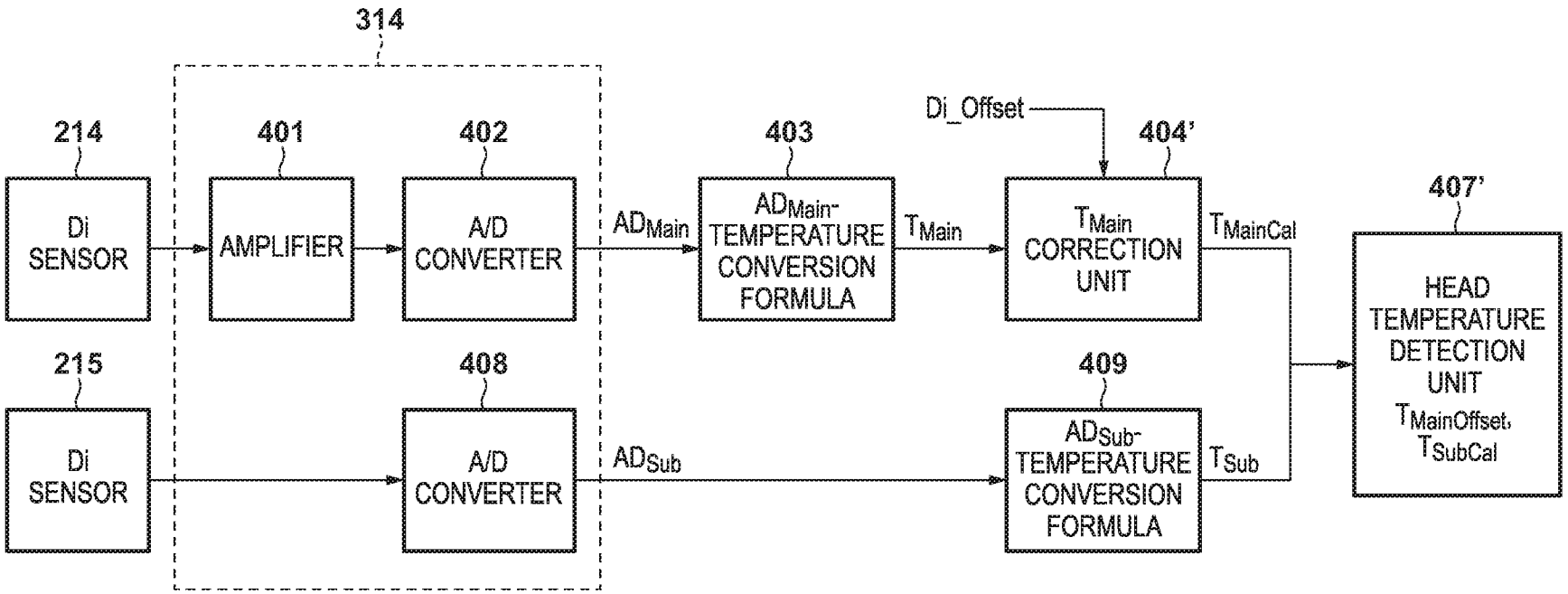
FIG. 8 is a block diagram showing the processing flow of a head temperature control circuit according to the second embodiment.

FIG. 8 is a block diagram showing the flow of processing in a head temperature controller 314 using a program stored/loaded in a ROM 301/RAM 302. Note that in FIG. 8, the same reference numerals as those described with reference to FIG. 4 of the first embodiment denote the similar components and a description thereof will be omitted.

A voltage input from MainDi 214 is amplified by an amplifier 401 and converted into a digital signal by an A/D converter 402. A digital signal $AD_{Main}$ is converted into a head temperature $T_{Main}$ by an $AD_{Main}$-temperature conversion formula 403.

Figure 9:
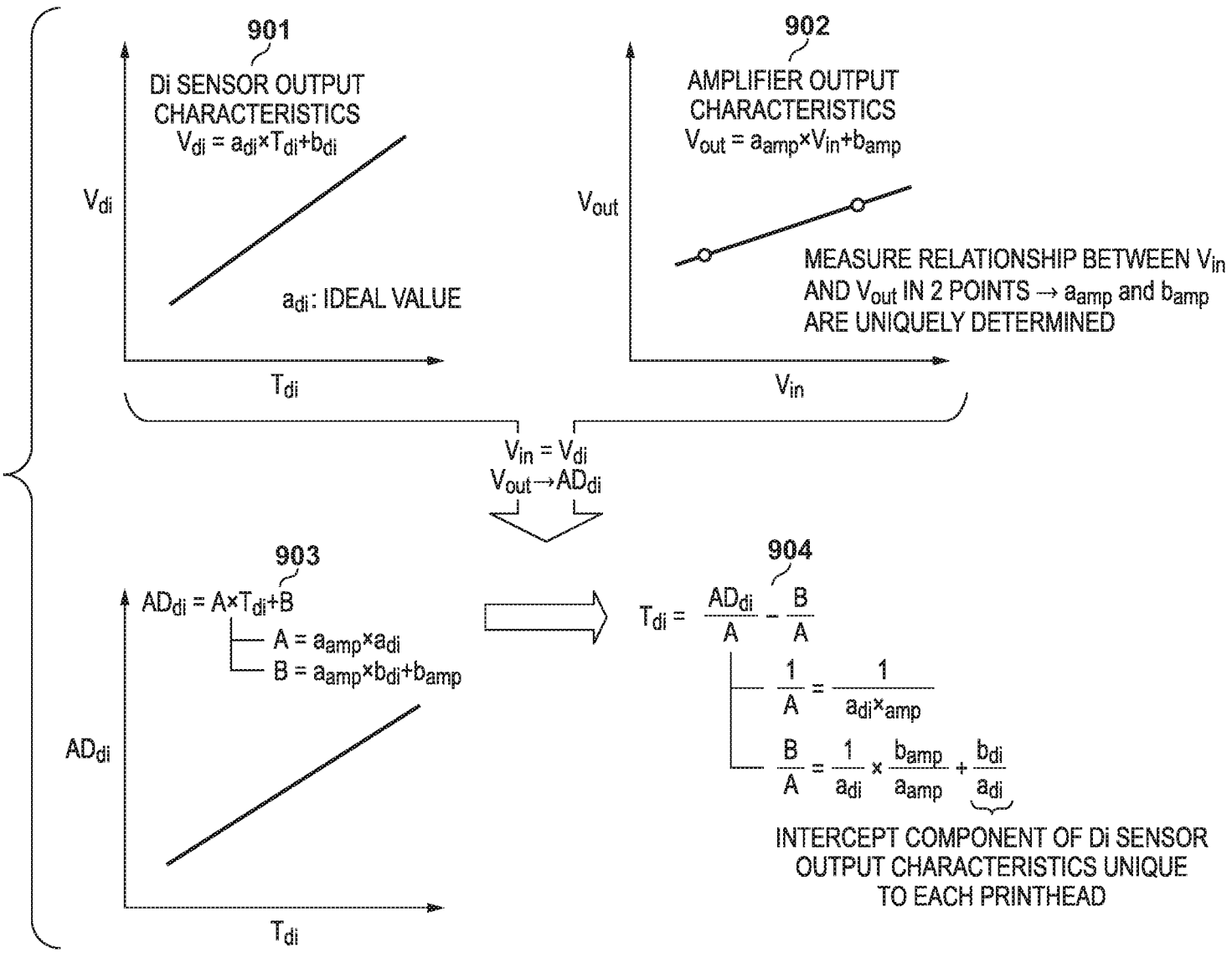
FIG. 9 is a view showing an $AD_{Main}$-temperature conversion formula and a correction method according to the second embodiment.

FIG. 9 is a view for explaining the $AD_{Main}$-temperature conversion formula.

As shown in FIG. 9, an output voltage $V_{di}$ of the Di sensor can be expressed by a linear function 901 of a head temperature $T_{di}$ detected by the Di sensor. This linear function represents the output characteristic of the Di sensor. An output voltage $V_{out}$ of the amplifier can be expressed by a linear function 902 of an input voltage $V_{in}$. This linear function represents the output characteristic of the amplifier. Since a signal after amplification is linearly converted by the A/D converter, a corresponding digital signal $AD_{di}$ is expressed as a linear function 903 of a detected temperature $T_{di}$ of the Di sensor.

That is, the $AD_{Main}$-temperature conversion formula 403 of MainDi can be described as the linear function 903, and has parameters of a slope and an intercept. In the second embodiment, the manufacturing variation of the amplifier is corrected by calibrating the parameters of the $AD_{Main}$-temperature conversion formula.

More specifically, at the time of manufacturing the amplifier, the relationship between the input voltage $V_{in}$ and the output voltage $V_{out}$ is obtained by two-point measurement. This can uniquely determine a slope component $a_{amp}$ and an intercept component $b_{amp}$ of the output characteristic of the amplifier. Since the variation of a slope component am indicating the output characteristic of the Di sensor can be suppressed, the slope component may be assumed to have an ideal value. Assuming that the intercept component of the output characteristic of the Di sensor has an ideal value, a slope component A and an intercept component B of the $AD_{di}$-temperature conversion formula 903 are calculated and stored in the ROM 301. The calibration method of this conversion formula will be referred to as two-point correction hereinafter.

By rewriting the $AD_{di}$-temperature conversion formula 903 to have only the temperature $T_{di}$ on the left-hand side, a formula 904 is obtained. In the formula 904, $b_{di}$ assumed as an ideal value appears in the form of $b_{di}/a_{di}$ in part of the intercept component. That is, an error occurring when $b_{di}$ is not an ideal value can be corrected by adding, to the temperature $T_{di}$ obtained by the formula 904, an offset temperature corresponding to the manufacturing variation of the Di sensor.

Referring back to FIG. 8, for the obtained head temperature $T_{Main}$, it is necessary to correct the manufacturing variation of the Di sensor. In this embodiment, a $T_{Main}$ correction unit 404' adds an offset correction value Di_Offset of the Di sensor to $T_{Main}$. This acquires a corrected head temperature $T_{MainCal}$ of MainDi. In this example, Di_Offset is a correction value of the manufacturing variation of the Di sensor, and is the characteristic value of a head written in a fuse ROM 317 in the manufacturing stage of the head.

More specifically, similar to the first embodiment, in accordance with a Di sensor rank written in the fuse ROM 317, a corresponding temperature in Table 1 is added as Di_Offset, thereby correcting the manufacturing variation of the Di sensor which has not been corrected by two-point correction.

In the first embodiment, comparison correction with the environment temperature is performed. This is because since an error in the same rank becomes larger by performing offset correction in accordance with the Di sensor rank and the amplifier rank, and the slope component of the output characteristic of the amplifier is not considered, the error cannot be ignored. On the other hand, in the second embodiment, since offset correction by designating the rank is performed only for correction of the Di sensor and the slope component of the output characteristic is also taken into consideration by two-point correction of the amplifier, an error becomes small. Therefore, the second embodiment does not require comparison correction with the environment temperature, unlike the first embodiment.

A head temperature $T_{sub}$ obtained from SubDi is acquired in the same manner as in the first embodiment described with reference to FIG. 4.

Then, a head temperature detection unit 407' sets an offset value of $T_{sub}$ using the corrected head temperature $T_{MainCal}$ of MainDi. Thus, a head temperature $T_{SubCal}$ of SubDi is acquired.

Figure 10A:
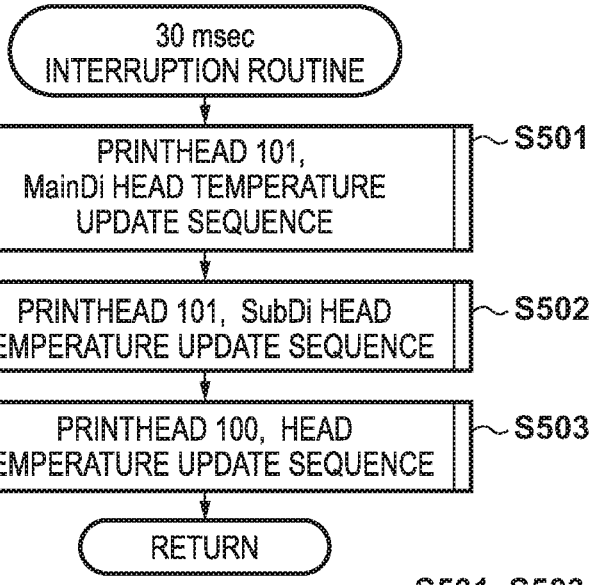
FIGS. 10A, 10B, and 10C are flowcharts each illustrating head temperature acquisition processing for each Di sensor according to the second embodiment.
Figure 10B:
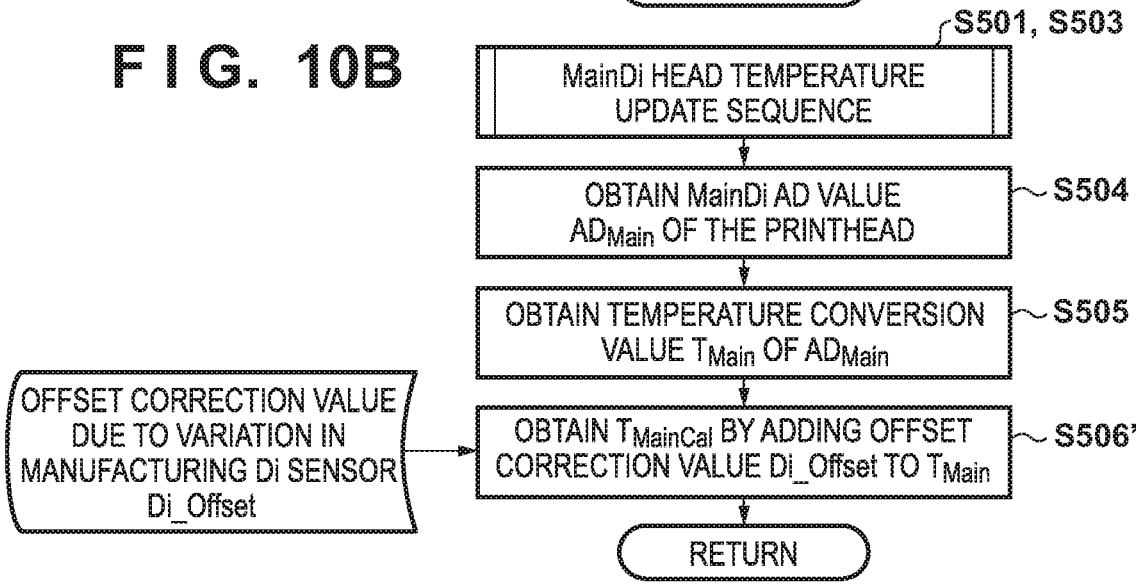
Figure 10C:
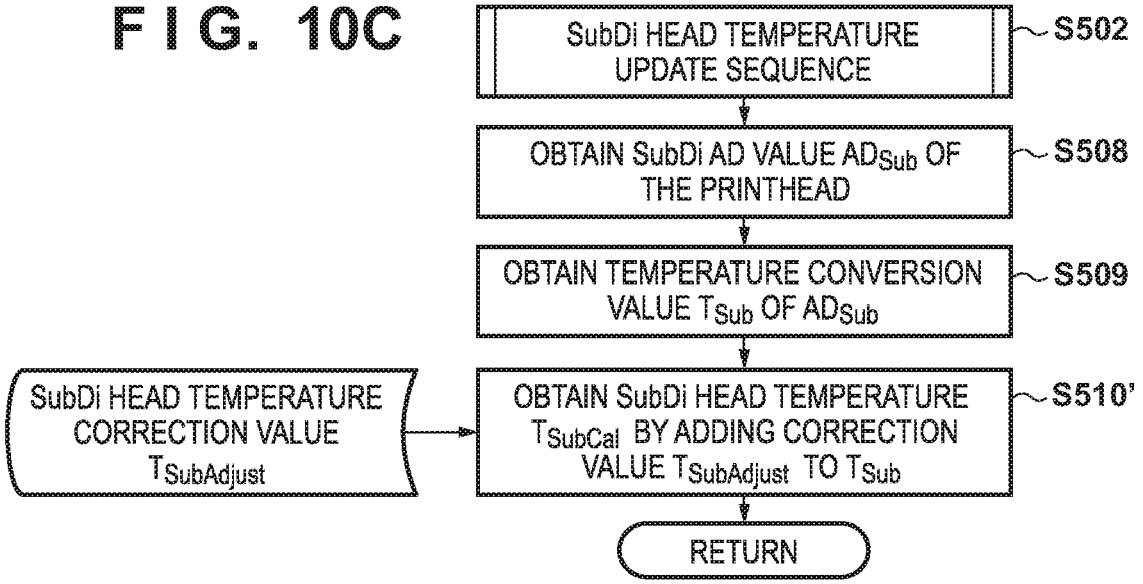

FIGS. 10A to 10C are flowcharts illustrating the head temperature acquisition method for MainDi and SubDi of the printhead according to the second embodiment. FIG. 10A shows an outline of the processing of the head temperature update routine that interrupts at an interval of 30 ms. FIG. 10B shows the head temperature update sequence of MainDi 214. FIG. 10C shows the head temperature update sequence of SubDi 215. Note that in FIG. 10A to 10C, the same step numbers as those described in the first embodiment with reference to FIG. 5 denote the same processing steps and a description thereof will be omitted.

As will be apparent by comparing FIGS. 10A and 5A, the processing of the head temperature update routine that interrupts at an interval of 30 ms is the same as in the first embodiment and a description thereof will be omitted.

Referring to FIG. 10B, in the head temperature update sequence by MainDi 214, steps S504 and S505 are executed. In step S506', the manufacturing variation of the Di sensor is corrected. In this embodiment, the offset correction value Di_Offset of MainDi 214 is added to the head temperature $T_{Main}$, thereby deriving $T_{MainCal}$. At this time, in accordance with the Di sensor rank written in the fuse ROM 317 of the printhead, a corresponding value in Table 1 is applied to Di_Offset.

Referring to FIG. 10C, in the head temperature update sequence by SubDi 215, steps S508 and S509 are executed. In step S510', a head temperature correction value $T_{SubAdjust}$ of SubDi is added to the head temperature $T_{Sub}$, thereby acquiring the corrected head temperature $T_{SubCal}$ of SubDi 215. Note that a method of acquiring the head temperature correction value $T_{SubAdjust}$ will be described later.

Figure 11A:
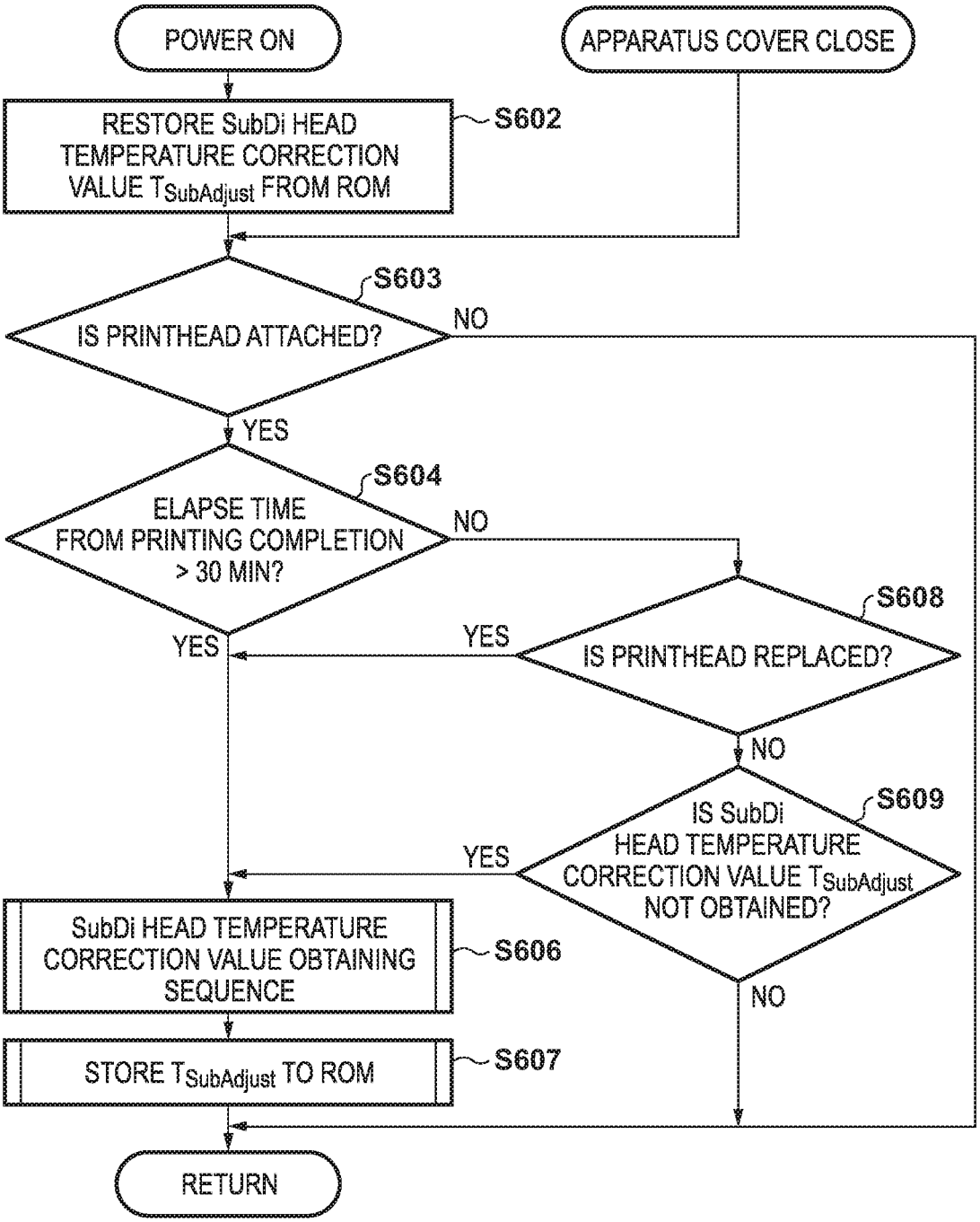
FIGS. 11A and 11B are flowcharts each illustrating head temperature correction value acquisition processing according to the second embodiment.
Figure 11B:
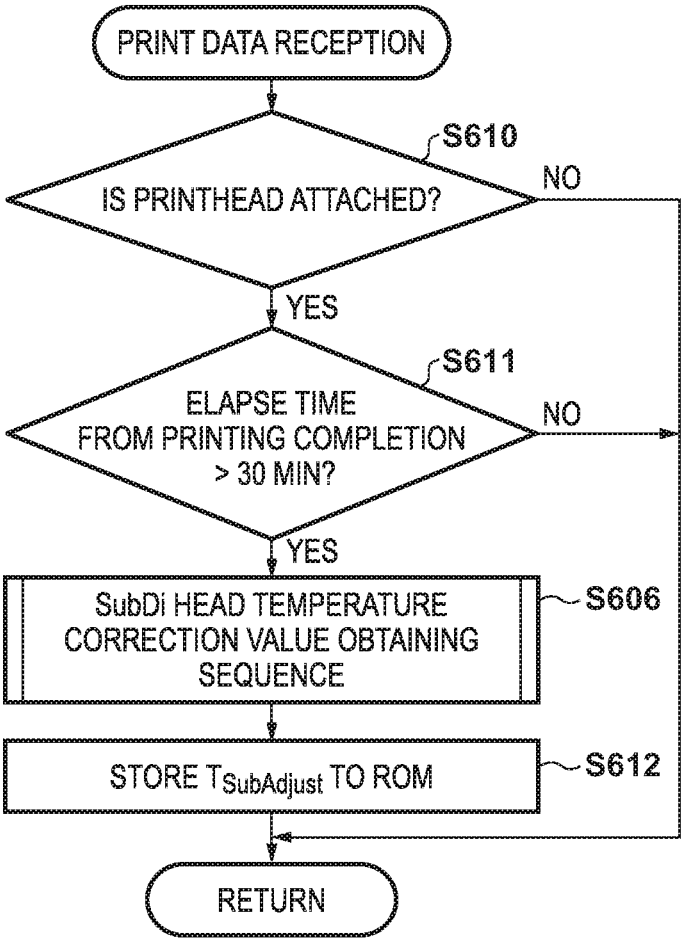

FIGS. 11A and 11B are flowcharts illustrating processing of acquiring the head temperature correction value of SubDi. Note that in FIGS. 11A and 11B, the same step numbers as those described in the first embodiment with reference to FIGS. 6A and 6B denote the same processing steps and a description thereof will be omitted.

As a timing of acquiring the head temperature correction value of SubDi, a timing at which the head temperature of SubDi 215 is equal to the head temperature of MainDi 214 as a comparison target is desirable.

More specifically, a timing at the time of powering on the printing apparatus or a timing immediately after the printhead is replaced is considered. To replace the printhead while the power is ON, it is necessary to open/close the cover of the printing apparatus. Therefore, as shown in FIG. 11A, the head temperature correction value acquisition procedure starts at the time of closing the cover of the printing apparatus in addition to the time of power-on. As shown in FIG. 11B, by providing a start point before the start of printing, the head temperature correction value is acquired again. If an attempt is made to acquire the head temperature correction value immediately after a print operation, the heat distribution of the printhead is not eliminated sufficiently, and thus an unexpectedly large value may be input to a correction value. Therefore, it is important to check whether a sufficient time has elapsed since head temperature adjustment control, and acquire the correction value in a state in which the temperature variation in the printhead is eliminated sufficiently.

As will be apparent by comparing FIGS. 11A and 6A, in FIG. 11A, processing obtained by excluding, from FIG. 6A, the processing in step S601 of updating the environment temperature and the processing in step S605 of the head temperature correction value acquisition sequence of MainDi is executed. Note that referring to FIG. 11A, if it is determined in step S604 that the elapsed time since the end of printing exceeds 30 min, it is determined that the head temperature variation has been eliminated sufficiently, and the process shifts to the head temperature correction value acquisition sequence of SubDi in step S606. If it is determined in step S604 that the elapsed time since the end of printing is shorter than 30 min, it is determined that the head temperature variation has not been eliminated sufficiently, and the process advances to step S608.

If it is determined in step S608 that the printhead has been replaced, it is determined that no temperature variation occurs in the replaced printhead, and the process shifts to the head temperature correction value acquisition sequence of SubDi in step S606.

As will be apparent by comparing FIGS. 11B and 6B, in FIG. 11B, processing obtained by excluding the processing in step S605 of the head temperature correction value acquisition sequence of MainDi from FIG. 6B is executed. Note that referring to FIG. 11B, if it is determined in step S611 that the elapsed time since the end of printing exceeds 30 min, it is determined that the head temperature variation has been eliminated sufficiently, and the process shifts to the head temperature correction value acquisition sequence of SubDi in step S606.

The head temperature correction value acquisition sequence of SubDi in step S606 will now be described.

Figure 12:
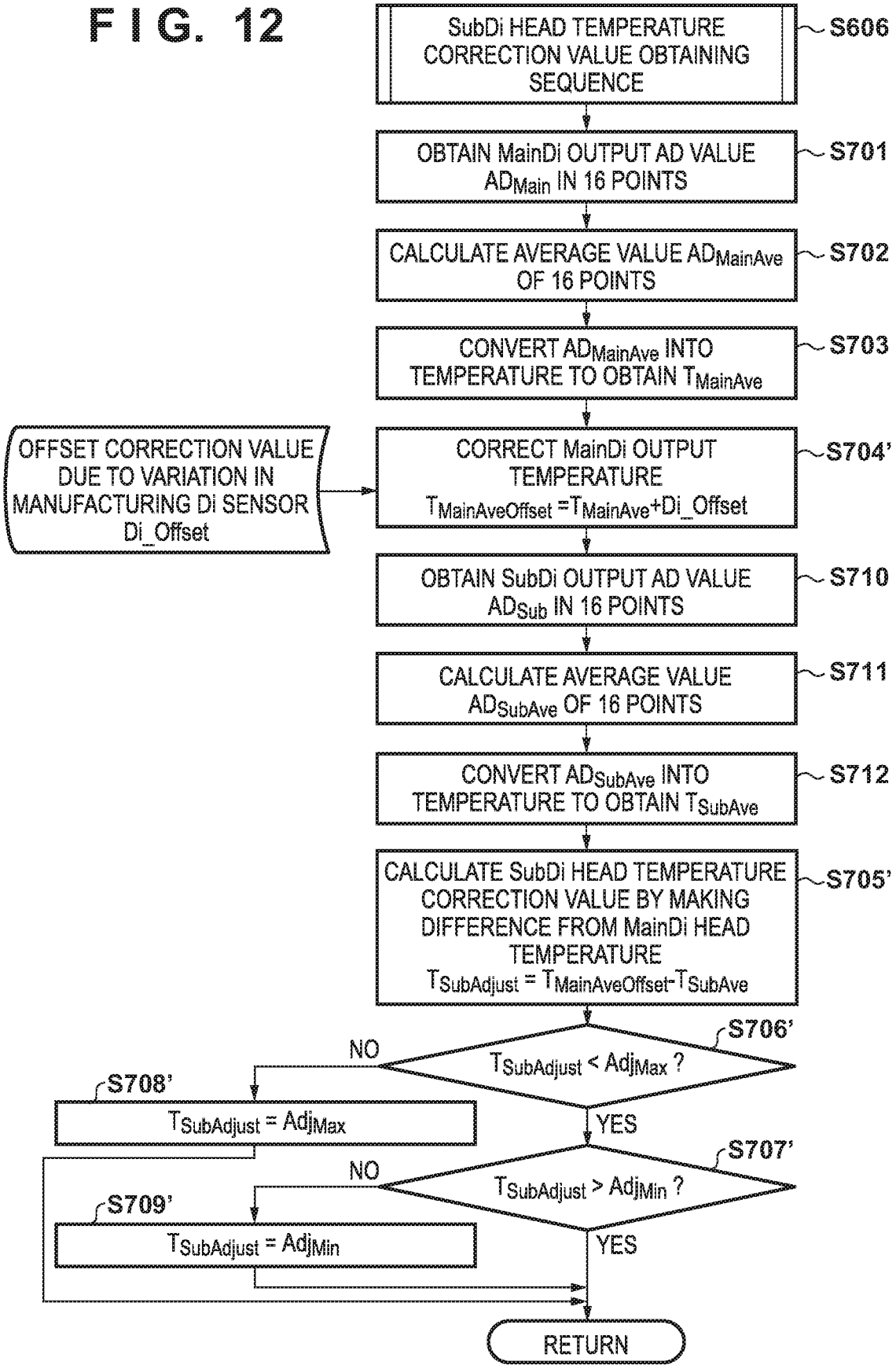
FIG. 12 is a flowchart illustrating the head temperature correction value acquisition sequence of the Di sensor according to the second embodiment.

FIG. 12 is a flowchart illustrating the head temperature correction value acquisition sequence of SubDi. Note that in FIG. 12, the same step numbers as those described in the first embodiment with reference to FIG. 7 denote the same processing steps and a description thereof will be omitted.

Referring to FIG. 12, after executing steps S701 to S703, in step S704', the offset correction value Di_Offset is added to correct the manufacturing variation of MainDi. This derives a corrected temperature $T_{MainAveOffset}$ of MainDi. Then, in step S710 to S712, a head temperature $T_{SubAve}$ of SubDi is acquired.

In step S705', the difference between the head temperature $T_{MainAveOffset}$ of MainDi acquired in step S704' and $T_{SubAve}$ acquired in step S712 is obtained. This derives the head temperature correction value $T_{SubAdjust}$ of SubDi. The head temperature variation is eliminated mainly by thermal conduction, which is a high-speed phenomenon. Therefore, at the timing of acquiring the head temperature correction value of SubDi, a large difference is hardly generated between the head temperatures of MainDi and SubDi. However, processing of imposing limitations, as in steps S706' to S709', may be performed. These processing steps are obtained by simply replacing the processes in steps S706 to S709 of FIG. 7 in the first embodiment with SubDi, and a description thereof will be omitted.

Therefore, according to the above-described embodiment, by adding a step of confirming the output characteristic of the amplifier at the time of manufacturing the circuit, and performing two-point correction for the amplifier for amplifying the voltage output from MainDi, it is possible to perform head temperature detection with high accuracy, as compared to the first embodiment. Furthermore, since it is not necessary to perform comparison correction with the environment temperature, the correction value acquisition timing of SubDi is not limited by the correction acquisition timing of MainDi, unlike the first embodiment. Therefore, the process need not always stand by until 30 min elapse since the end of printing. As long as the head temperature variation is eliminated sufficiently, the update frequency of the correction value may be increased.

Note that in the above-described two embodiments, offset correction concerning the manufacturing variation is performed for the head temperature converted by the $AD_{Main}$-temperature conversion formula. However, offset correction may be performed for the analog value before A/D conversion.

Furthermore, in the above-described two embodiments, the manufacturing variation of the Di sensor and that of the amplifier are ranked and stored so as to decrease the memory capacity of the printing apparatus and the printhead. The present invention, however, is not limited to this. For example, a temperature in a decimal level to be corrected may be written in the memory to improve the accuracy.

Furthermore, in the above-described two embodiments, the voltage output from SubDi is not amplified by assuming prevention of an excessive temperature rise at the time of non-printing discharge as the application purpose of SubDi. The present invention, however, is not limited to this. For example, if it is necessary to perform temperature detection with higher accuracy for print control or the like, an amplifier may be added to SubDi.

In addition, the present invention is applicable to a single-function inkjet printing apparatus as well as a facsimile machine, a copying machine, a word processor, and a multifunction peripheral each of which uses an inkjet printing apparatus as a print unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-073079, filed Apr. 5, 2019, which is hereby incorporated by reference herein in its entirety.

What is claimed is:

1. A printing apparatus comprising:

a printhead including a plurality of print elements for generating energy used for printing an image on a print medium, a first temperature detection element and a second temperature detection element at positions different in a direction of a print element array in which the plurality of print elements are arrayed;

a first correction unit configured to correct a signal concerning a head temperature based on an output from the first temperature detection element; and a second correction unit configured to correct, based on the signal concerning the head temperature corrected by the first correction unit, a signal concerning a head temperature output from the second temperature detection element.

2. The apparatus according to claim 1, wherein the first temperature detection element comprises a first diode sensor, and the second temperature detection element comprises a second diode sensor.

3. The apparatus according to claim 2, further comprising a storage unit configured to store a first correction value for correcting a variation of an output characteristic of the first temperature detection element, wherein the first correction unit corrects the signal concerning the head temperature based on the first correction value stored in the storage unit.

4. The apparatus according to claim 3, further comprising an amplification circuit configured to amplify a voltage of the signal concerning the head temperature output from the first temperature detection element, wherein the first correction unit corrects, based on the first correction value, the signal concerning the head temperature output from the amplification circuit.

5. The apparatus according to claim 4, further comprising:

a first A/D converter configured to A/D-convert the signal concerning the head temperature amplified by the amplification circuit;

a first conversion unit configured to convert, into a head temperature, the signal concerning the head temperature converted into a digital signal by the first A/D converter;

a second A/D converter configured to A/D-convert the signal concerning the head temperature output from the second temperature detection element; and a second conversion unit configured to convert, into a head temperature, the signal concerning the head temperature converted into a digital signal by the second A/D converter.

6. The apparatus according to claim 5, wherein the storage unit stores a second correction value for correcting a variation of an output characteristic of the amplification circuit, and the first correction unit further corrects, based on the second correction value, the signal concerning the head temperature output from the amplification circuit.

7. The apparatus according to claim 6, further comprising a measurement unit configured to measure an environment temperature of the printing apparatus, wherein the first correction unit derives a corrected head temperature, based on a difference between the environment temperature measured by the measurement unit and a head temperature indicated by the signal concerning the head temperature corrected based on the first correction value and the second correction value.

8. The apparatus according to claim 7, wherein based on a difference between a head temperature output from the second temperature detection element and the head temperature concerning the first temperature detection element corrected based on the first correction value and the second correction value and the difference between the environment temperature measured by the measurement unit and the head temperature indicated by the signal concerning the corrected head temperature, the second correction unit corrects the head temperature output from the second temperature detection element.

9. The apparatus according to claim 8, wherein after a predetermined time elapses since an end of printing by the printhead, correction by the first correction unit and correction by the second correction unit are executed.

10. The apparatus according to claim 9, wherein the correction by the first correction unit is executed for a head temperature obtained by acquiring a predetermined number of digital signals by the first A/D converter, calculating an average value of the acquired digital signals, and converting the calculated average value by the first conversion unit, and the correction by the second correction unit is executed for a head temperature obtained by acquiring a predetermined number of digital signals by the second A/D converter, calculating an average value of the acquired digital signals, and converting the calculated average value by the second conversion unit.

11. The apparatus according to claim 7, wherein predetermined limitations are imposed on correction by the first correction unit and correction by the second correction unit.

12. The apparatus according to claim 2, wherein each of a relationship between an output voltage of the first diode sensor and a temperature detected by the first diode sensor and a relationship between an output voltage of the second diode sensor and a temperature detected by the second diode sensor is expressed by a linear function, and each of correction by the first correction unit and correction by the second correction unit corrects a slope and an intercept of the linear function.

13. The apparatus according to claim 1, wherein the plurality of print elements are a plurality of heat generating elements for generating energy used for discharging ink through a plurality of orifices in correspondence with the plurality of heat generating elements.

14. A method of correcting a head temperature detected by a printing apparatus including a printhead with a plurality of print elements for generating energy used for printing an image on a print medium, a first temperature detection element and a second temperature detection element at positions different in a direction of a print element array in which the plurality of print elements are arrayed, the method comprising:

correcting a signal concerning a head temperature based on an output from the first temperature detection element; and correcting, based on the corrected signal concerning the head temperature, a signal concerning a head temperature output from the second temperature detection element.

15. The method according to claim 14, further comprising storing, in a memory, a first correction value for correcting a variation of an output characteristic of the first temperature detection element, wherein the signal concerning the head temperature based on the first correction value stored in the memory is corrected.

16. The method according to claim 15, wherein in the correcting the signal concerning the head temperature based on the output from the first temperature detection element, the signal concerning the head temperature amplified and output by an amplification circuit is corrected based on the first correction value.

17. The method according to claim 16, further comprising:

converting, into a head temperature, the signal concerning the head temperature converted into a digital signal by a first A/D converter configured to A/D-convert the signal concerning the head temperature amplified by the amplification circuit; and converting, into a head temperature, the signal concerning the head temperature converted into a digital signal by a second A/D converter configured to A/D-convert the signal concerning the head temperature output from the second temperature detection element.

18. The method according to claim 17, wherein the memory stores a second correction value for correcting a variation of an output characteristic of the amplification circuit, and in the correcting the signal concerning the head temperature based on the output from the first temperature detection element, the signal concerning the head temperature output from the amplification circuit is corrected based on the second correction value.

19. The method according to claim 18, further comprising measuring an environment temperature of the printing apparatus, wherein a corrected head temperature is derived based on a difference between the measured environment temperature and a head temperature indicated by the signal concerning the head temperature corrected based on the first correction value and the second correction value.

20. The method according to claim 19, wherein based on a difference between a head temperature output from the second temperature detection element and the head temperature concerning the first temperature detection element corrected based on the first correction value and the second correction value and the difference between the measured environment temperature and the head temperature indicated by the signal concerning the corrected head temperature, the head temperature output from the second temperature detection element is corrected.

* * * * *